US009165521B2

(12) United States Patent
Yamazaki et al.

(10) Patent No.: US 9,165,521 B2
(45) Date of Patent: Oct. 20, 2015

(54) FIELD SEQUENTIAL LIQUID CRYSTAL DISPLAY DEVICE AND DRIVING METHOD THEREOF

(75) Inventors: Shunpei Yamazaki, Setagaya (JP); Jun Koyama, Sagamihara (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 471 days.

(21) Appl. No.: 13/184,587

(22) Filed: Jul. 18, 2011

(65) Prior Publication Data

US 2012/0019567 A1 Jan. 26, 2012

(30) Foreign Application Priority Data

Jul. 26, 2010 (JP) ..... 2010-167161

(51) Int. Cl.
*G09G 3/36* (2006.01)
*G09G 3/34* (2006.01)

(52) U.S. Cl.
CPC ..... *G09G 3/3677* (2013.01); *G09G 3/342* (2013.01); *G09G 3/3413* (2013.01); *G09G 3/3688* (2013.01); *G09G 2310/0205* (2013.01); *G09G 2310/0218* (2013.01); *G09G 2310/0235* (2013.01); *G09G 2310/0286* (2013.01); *G09G 2310/0291* (2013.01); *G09G 2310/08* (2013.01); *G09G 2320/0242* (2013.01)

(58) Field of Classification Search
CPC ..... G09G 3/22–3/28; G09G 2310/0235–2310/0237; G09G 2320/045; G09G 2360/141
USPC ..... 345/87–104, 211–213
See application file for complete search history.

(56) References Cited

U.S. PATENT DOCUMENTS

| | | | |
|---|---|---|---|
| 6,448,951 | B1 | 9/2002 | Sakaguchi et al. |
| 6,597,348 | B1 | 7/2003 | Yamazaki et al. |
| 6,882,012 | B2 | 4/2005 | Yamazaki et al. |
| 7,193,593 | B2 | 3/2007 | Koyama et al. |

(Continued)

FOREIGN PATENT DOCUMENTS

| | | | |
|---|---|---|---|
| EP | 2187381 | A | 5/2010 |
| JP | 11-337904 | A | 12/1999 |

(Continued)

OTHER PUBLICATIONS

Baron et al., "36.4: Can Motion Compensation Eliminate Color Breakup of Moving Objects in Field-Sequential Color Displays?" SID Digest '96: SID International Symposium Digest of Technical Papers, 1996, vol. 27, pp. 843-846.

(Continued)

*Primary Examiner* — Sanghyuk Park
(74) *Attorney, Agent, or Firm* — Eric J. Robinson; Robinson Intellectual Property Law Office, P.C.

(57) ABSTRACT

To improve the image quality of a liquid crystal display device. In the liquid crystal display device, writing of an image signal and the turning on the backlights are not sequentially performed in the entire pixel portion but are sequentially performed per specific region of the pixel portion. Thus, it is possible to increase the frequency of input of an image signal to each pixel of the liquid crystal display device. Accordingly, deterioration of display such as color break generated in the liquid crystal display device can be suppressed, and the image quality can be improved.

7 Claims, 18 Drawing Sheets

(56) References Cited

U.S. PATENT DOCUMENTS

| | | | | |
|---|---|---|---|---|
| 7,224,339 | B2 | 5/2007 | Koyama et al. | |
| 7,268,756 | B2 | 9/2007 | Koyama et al. | |
| 7,317,438 | B2 | 1/2008 | Yamazaki et al. | |
| 7,365,729 | B2 | 4/2008 | Hong | |
| 7,385,579 | B2 | 6/2008 | Satake | |
| 7,391,486 | B2 | 6/2008 | Hong | |
| 7,403,177 | B2 | 7/2008 | Tanada et al. | |
| 7,425,937 | B2 | 9/2008 | Inukai | |
| 7,773,066 | B2 | 8/2010 | Yamazaki et al. | |
| 7,791,571 | B2 | 9/2010 | Ohtani et al. | |
| 7,834,830 | B2 | 11/2010 | Yamazaki et al. | |
| 7,855,770 | B2 | 12/2010 | Egi et al. | |
| 8,345,172 | B2 | 1/2013 | Kataoka | |
| 2002/0075249 | A1 | 6/2002 | Kubota et al. | |
| 2005/0012097 | A1 | 1/2005 | Yamazaki | |
| 2006/0262079 | A1* | 11/2006 | Seong et al. | 345/102 |
| 2007/0182682 | A1* | 8/2007 | Hong et al. | 345/88 |
| 2007/0279352 | A1* | 12/2007 | Tanaka | 345/87 |
| 2007/0279374 | A1 | 12/2007 | Kimura et al. | |
| 2008/0158141 | A1* | 7/2008 | Yoshihara et al. | 345/102 |
| 2008/0266312 | A1* | 10/2008 | Chen et al. | 345/589 |
| 2008/0273005 | A1* | 11/2008 | Chen et al. | 345/102 |
| 2009/0135129 | A1* | 5/2009 | Roth et al. | 345/102 |
| 2009/0321737 | A1 | 12/2009 | Isa et al. | |
| 2010/0117942 | A1 | 5/2010 | Kamada | |
| 2010/0148177 | A1 | 6/2010 | Koyama et al. | |
| 2010/0149435 | A1* | 6/2010 | Kataoka | 348/744 |
| 2010/0182282 | A1 | 7/2010 | Kurokawa et al. | |
| 2010/0265222 | A1* | 10/2010 | Tsuboi et al. | 345/205 |
| 2010/0265281 | A1 | 10/2010 | Furukawa et al. | |
| 2010/0289883 | A1* | 11/2010 | Goris et al. | 348/56 |
| 2010/0321420 | A1 | 12/2010 | Ohtani et al. | |
| 2011/0001725 | A1 | 1/2011 | Kurokawa | |
| 2011/0025729 | A1 | 2/2011 | Yamazaki et al. | |
| 2011/0051034 | A1 | 3/2011 | Egi et al. | |
| 2011/0248970 | A1 | 10/2011 | Koyama et al. | |
| 2011/0248978 | A1 | 10/2011 | Koyama et al. | |
| 2011/0249037 | A1 | 10/2011 | Koyama et al. | |
| 2011/0292088 | A1 | 12/2011 | Toyotaka et al. | |
| 2011/0310132 | A1 | 12/2011 | Kurokawa et al. | |
| 2011/0310133 | A1 | 12/2011 | Koyama et al. | |
| 2012/0002132 | A1 | 1/2012 | Yamazaki et al. | |

FOREIGN PATENT DOCUMENTS

| | | | |
|---|---|---|---|
| JP | 2002-062518 | | 2/2002 |
| JP | 2002-251175 | A | 9/2002 |
| JP | 2006-178126 | A | 7/2006 |
| JP | 2006-220685 | A | 8/2006 |
| JP | 2007-264211 | A | 10/2007 |
| JP | 2009-042405 | | 2/2009 |
| JP | 2009-042405 | A | 2/2009 |
| JP | 2010-113125 | A | 5/2010 |
| WO | WO-2006/067750 | | 6/2006 |
| WO | WO-2009/044909 | | 4/2009 |

OTHER PUBLICATIONS

Kurita et al., "Evaluation and Improvement of Picture Quality for Moving Images on Field-sequential Color Displays," IDW '00: Proceedings of the 17th International Display Workshops, 2000, pp. 69-72.

Taira et al., "A15 Field-Sequential Display without Color Break-Up using an AFLC Color Shutter," IDW '00: Proceedings of the 17th International Display Workshops, 2000, pp. 73-76.

Jarvenpaa, "7.2: Measuring Color Breakup of Stationary Images in Field-Sequential-Color Displays," SID Digest '04: SID International Symposium Digest of Technical Papers, 2004, vol. 35, pp. 82-85.

* cited by examiner

FIELD SEQUENTIAL LIQUID CRYSTAL DISPLAY DEVICE AND DRIVING METHOD THEREOF

BACKGROUND OF THE INVENTION

1. Field of the Invention

The present invention relates to liquid crystal display devices and driving methods thereof. In particular, the present invention relates to field-sequential liquid crystal display devices and driving methods thereof.

2. Description of the Related Art

As display methods of liquid crystal display devices, a color filter method and a field sequential method are known. In a color-filter liquid crystal display device, a plurality of subpixels which has color filters for transmitting only light of wavelengths with given colors (e.g., red (R), green (G), and blue (B)) is provided in each pixel. A desired color is expressed by control of transmission of white light in each subpixel and mixture of a plurality of colors in each pixel. In contrast, in a field-sequential liquid crystal display device, a plurality of light sources that emit lights of their respective colors (e.g., red (R), green (G), and blue (B)) are provided. A desired color is expressed by repeating on/off of the plurality of light sources and control of transmission of light of different colors in each pixel. In other words, the color filter method is a method by which a desired color is expressed by division of one pixel according to lights of given colors, and the field sequential method is a method by which a desired color is expressed by division of a display period according to lights of given colors.

The field-sequential liquid crystal display device has the following advantages over the color-filter liquid crystal display device. First, in the field-sequential liquid crystal display device, it is not necessary to provide subpixels in each pixel. Thus, the aperture ratio can be increased or the number of pixels can be increased. Second, in the field-sequential liquid crystal display device, it is not necessary to provide color filters. In other words, light loss caused by light absorption in the color filters does not occur. Therefore, transmittance can be improved and power consumption can be reduced.

Patent Document 1 discloses a field-sequential liquid crystal display device. Specifically, Patent Document 1 discloses a liquid crystal display device in which each pixel includes a transistor for controlling input of an image signal, a signal storage capacitor for holding the image signal, and a transistor for controlling transfer of an electrical charge from the signal storage capacitor to a display pixel capacitor. In the liquid crystal display device with the structure, input of an image signal to the signal storage capacitor and display based on an electrical charge held in the display pixel capacitor can be performed concurrently.

REFERENCE

Patent Document 1: Japanese Published Patent Application No. 2009-42405

SUMMARY OF THE INVENTION

As described above, in a field-sequential liquid crystal display device, a display period is divided by lights of given colors. For that reason, display perceived by a user is sometimes changed (degraded) from display based on original display information (such a phenomenon is also referred to as color breaks) because of a lack of a given piece of display information due to temporary interruption of display, such as a blink of the user. Thus, an object of one embodiment of the present invention is to suppress a decrease in image quality of a field-sequential liquid crystal display device.

According to one embodiment of the present invention, a liquid crystal display device includes a pixel portion including a plurality of pixels arranged in m rows and n columns; a driver circuit that scans an image signal for controlling transmission of light of a first color for n pixels arranged in a first row to n pixels arranged in an A-th row (A is a natural number less than or equal to m/2) and an image signal for controlling transmission of light of a second color for n pixels arranged in a (A+1)-th row to n pixels arranged in a 2A-th row in parallel; a backlight in which a plurality of backlight units provided with light sources emitting lights of their respective colors is arranged in a matrix; and a backlight control circuit that makes a light source of the light of the first color turn on in backlight units for irradiating the n pixels arranged in the first row to n pixels arranged in a B-th row (B is a natural number less than or equal to A/2) with light and makes a light source of the light of the second color turn on in backlight units for irradiating the n pixels arranged in the (A+1)-th row to n pixels arranged in a (A+B)-th row with light among the plurality of backlight units in a period in which the driver circuit scans the image signal for controlling transmission of the light of the first color for n pixels arranged in a (B+1)-th row to the n pixels arranged in the A-th row and the image signal for controlling transmission of the light of the second color for n pixels arranged in a (A+B+1)-th row to the n pixels arranged in the 2A-th row.

According to another embodiment of the present invention, a driving method of a liquid crystal display device forms an image in a pixel portion by repeating on and off of a plurality of light sources emitting lights of their respective colors and by controlling transmission of the lights of their respective colors depending on a plurality of pixels arranged in m rows and n columns (m and n are each a natural number greater than or equal to 4). The driving method includes the steps of: in a first period in which input of an image signal for controlling transmission of light of a first color is sequentially performed for n pixels arranged in a first row to n pixels arranged in an A-th row (A is a natural number less than or equal to m/2) and input of an image signal for controlling transmission of light of a second color is sequentially performed for n pixels arranged in a (A+1)-th row to n pixels arranged in a 2A-th row, supplying the light of the first color to the n pixels arranged in the first row to the n pixels arranged in a B-th row (B is a natural number less than or equal to A/2) and supplying the light of the second color to the n pixels arranged in the (A+1)-th row to n pixels arranged in a (A+B)-th row after the input of the image signal for controlling transmission of the light of the first color in the n pixels arranged in the first row to the n pixels arranged in the B-th row and the input of the image signal for controlling transmission of the light of the second color in the n pixels arranged in the (A+1)-th row to the n pixels arranged in the (A+B)-th row; in a second period in which input of an image signal for controlling transmission of light of a third color is performed for the n pixels arranged in the first row to the n pixels arranged in the A-th row and input of an image signal for controlling transmission of light of a fourth color is performed for the n pixels arranged in the (A+1)-th row to the n pixels arranged in the 2A-th row after the first period, supplying the light of the third color to the n pixels arranged in the first row to the n pixels arranged in the B-th row and supplying the light of the fourth color to the n pixels arranged in the (A+1)-th row to the n pixels arranged in the (A+B)-th row after the input of the image signal for controlling transmission of the light of the third color in the n pixels arranged in the first row to the n pixels arranged in the B-th row and the input of the image signal for controlling transmission of the light of the fourth color in the n pixels arranged in the (A+1)-th row to the n pixels arranged in the (A+B)-th row; forming a first image displayed in the pixel portion by using the light of the first color and the light of the second color; forming a second image displayed in the pixel portion by using the light of the third color and the light of the fourth color, following the first image; forming the light of the first color and the light of the second color by turning on any one of the plurality of light sources; and forming the light of the third color and the light of the fourth color by turning on at least two light sources of the plurality of light sources.

In the liquid crystal display device according to one embodiment of the present invention, input of image signals and the turning on the backlights are not sequentially performed in the entire pixel portion but can be sequentially performed per specific region of the pixel portion. Thus, it is possible to increase the frequency of input of an image signal to each pixel of the liquid crystal display device. Accordingly, deterioration of display such as color break generated in the liquid crystal display device can be suppressed, and the image quality can be improved.

BRIEF DESCRIPTION OF THE DRAWINGS

FIGS. 16A, 16B, 16C1, 16C2, 16D1, 16D2, 16E1, and 16E2 illustrate examples of one embodiment of a substrate used in a liquid crystal display device.

DETAILED DESCRIPTION OF THE INVENTION

Hereinafter, embodiments of the present invention will be described in detail with reference to the accompanying drawings. Note that the present invention is not limited to the description below, and it is easily understood by those skilled in the art that a variety of changes and modifications can be made without departing from the spirit and scope of the present invention. Therefore, the present invention should not be limited to the descriptions of the embodiments below.

First, a liquid crystal display device according to one embodiment of the present invention will be described with reference to FIGS. 1A and 1B, FIGS. 2A to 2C, FIGS. 3A to 3D, FIGS. 4A and 4B, FIG. 5, and FIG. 6.

<Structure Example of Liquid Crystal Display Device>

Figure 1A:
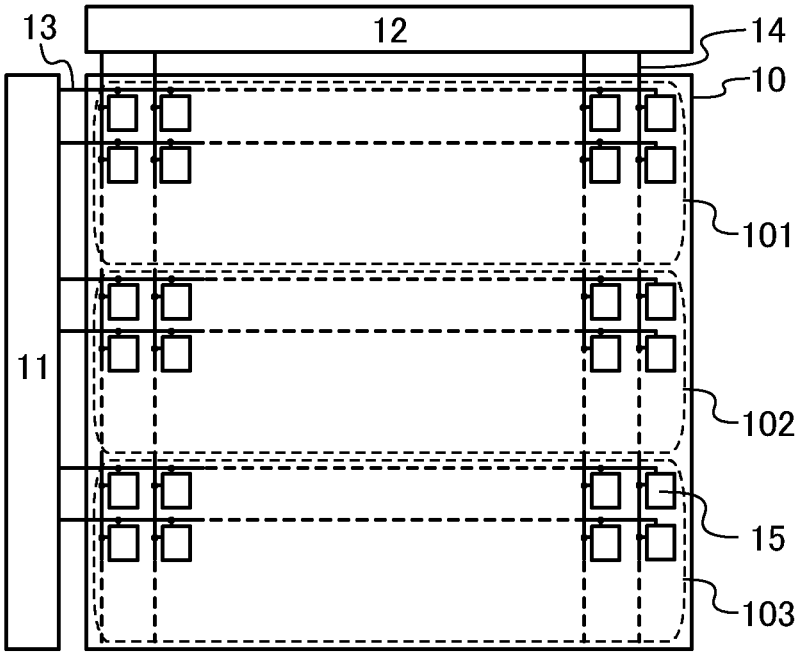
FIG. 1A illustrates a structure example of a liquid crystal display device.

FIG. 1A illustrates a structure example of a liquid crystal display device. The liquid crystal display device illustrated in FIG. 1A includes a pixel portion 10, a scan line driver circuit 11, a signal line driver circuit 12, m scan lines 13 which are arranged parallel (or substantially parallel) to each other and whose potentials are controlled by the scan line driver circuit 11, and n signal lines 14 which are arranged parallel (or substantially parallel) to each other and whose potentials are controlled by the signal line driver circuit 12. The pixel portion 10 is divided into three regions (regions 101 to 103), and each region includes a plurality of pixels arranged in a matrix. Each of the scan lines 13 is electrically connected to the n pixels in the corresponding row, among the plurality of pixels arranged in m rows and n columns in the pixel portion 10. Each of the signal lines 14 is electrically connected to the m pixels in the corresponding column, among the plurality of pixels arranged in the m rows and the n columns.

Figure 1B:
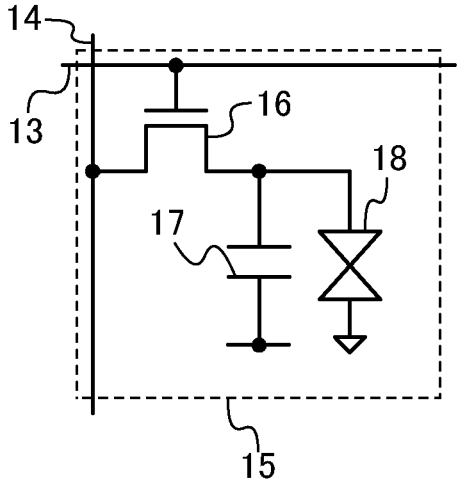
FIG. 1B illustrates a structure example of a pixel of the liquid crystal display device.

FIG. 1B illustrates an example of a circuit configuration of a pixel 15 included in the liquid crystal display device illustrated in FIG. 1A. The pixel 15 in FIG. 1B includes a transistor 16, a capacitor 17, and a liquid crystal element 18. A gate of the transistor 16 is electrically connected to the scan line 13, and one of a source and a drain of the transistor 16 is electrically connected to the signal line 14. One of electrodes of the capacitor 17 is electrically connected to the other of the source and the drain of the transistor 16, and the other of the electrodes of the capacitor 17 is electrically connected to a wiring for supplying a capacitor potential (the wiring is also referred to as a capacitor wiring). One of electrodes (also referred to as a pixel electrode) of the liquid crystal element 18 is electrically connected to the other of the source and the drain of the transistor 16 and one of the electrodes of the capacitor 17, and the other of the electrodes (also referred to as a common electrode or a counter electrode) of the liquid crystal element 18 is electrically connected to a wiring for supplying a common potential (also referred to as a counter potential). The transistor 16 is an n-channel transistor. The capacitor potential and the common potential can be the same potential.

<Structure Example of Scan Line Driver Circuit 11>

Figure 2A:
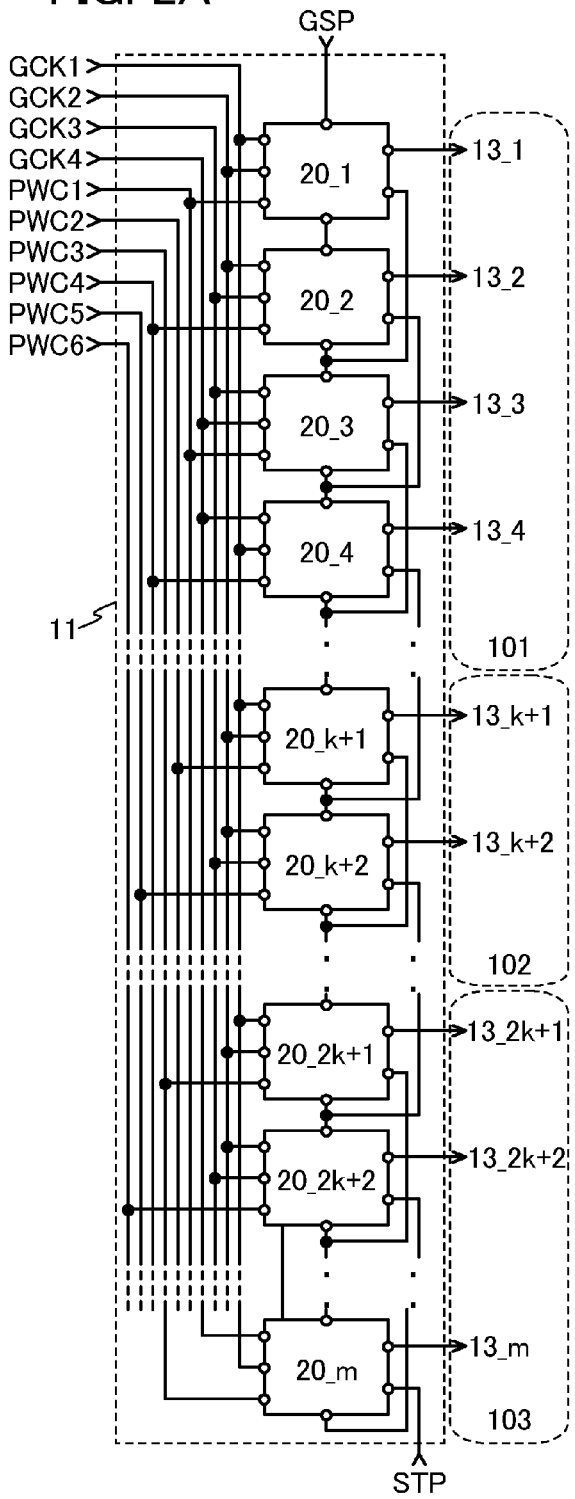
FIG. 2A illustrates a structure example of a scan line driver circuit.

FIG. 2A illustrates a structure example of the scan line driver circuit 11 included in the liquid crystal display device in FIG. 1A. The scan line driver circuit 11 illustrated in FIG.

2A includes: respective wirings for supplying first to fourth clock signals (GCK1 to GCK4) for the scan line driver circuit; respective wirings for supplying first to sixth pulse-width control signals (PWC1 to PWC6); and a first pulse output circuit 20_1 which is electrically connected to the scan line 13_1 in the first row to an m-th pulse output circuit 20_*m* which is electrically connected to the scan line 13_*m* in the m-th row. Note that here, the first pulse output circuit 20_1 to the k-th pulse output circuit 20_*k* (k is less than m/2 and a multiple of 4) are electrically connected to the respective scan lines 13_1 to 13_*k* provided for the region 101; the (k+1)-th pulse output circuit 20_(k+1) to the 2k-th pulse output circuit 20_2k are electrically connected to the respective scan lines 13_(k+1) to 13_2k provided for the region 102; and the (2k+1)-th pulse output circuit 20_(2k+1) to the m-th pulse output circuit 20_*m* are electrically connected to the respective scan lines 13_(2k+1) to 13_*m* provided for the region 103. The first pulse output circuit 20_1 to the m-th pulse output circuit 20_*m* are configured to shift a shift pulse sequentially per shift period in response to a start pulse (GSP) for the scan line driver circuit which is input to the first pulse output circuit 20_1. Note that a plurality of shift pulses can be shifted in parallel in the first pulse output circuit 20_1 to the m-th pulse output circuit 20_*m*. In other words, even in a period in which a shift pulse is shifted in the first pulse output circuit 20_1 to the m-th pulse output circuit 20_*m*, the start pulse (GSP) for the scan line driver circuit can be input to the first pulse output circuit 20_1.

Figure 2B:
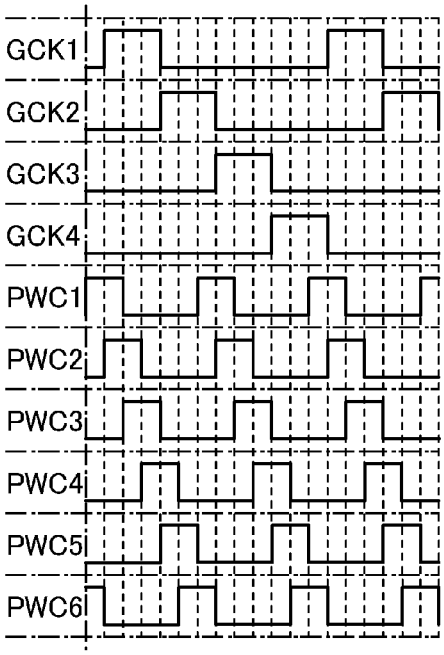
FIG. 2B is a timing diagram illustrating an example of signals for the scan line driver circuit.

FIG. 2B illustrates examples of specific waveforms of the above-described signals. The first clock signal (GCK1) for the scan line driver circuit in FIG. 2B periodically repeats a high-level potential (high power supply potential (Vdd)) and a low-level potential (low power supply potential (Vss)), and has a duty ratio of ¼. The second clock signal (GCK2) for the scan line driver circuit is a signal whose phase is deviated by ¼ period from the first clock signal (GCK1) for the scan line driver circuit; the third clock signal (GCK3) for the scan line driver circuit is a signal whose phase is deviated by ½ period from the first clock signal (GCK1) for the scan line driver circuit; and the fourth clock signal (GCK4) for the scan line driver circuit is a signal whose phase is deviated by ¾ period from the first clock signal (GCK1) for the scan line driver circuit. The first pulse-width control signal (PWC1) periodically repeats the high-level potential (high power supply potential (Vdd)) and the low-level potential (low power supply potential (Vss)), and has a duty ratio of ⅓. The second pulse-width control signal (PWC2) is a signal whose phase is deviated by ⅙ period from the first pulse-width control signal (PWC1); the third pulse-width control signal (PWC3) is a signal whose phase is deviated by ⅓ period from the first pulse-width control signal (PWC1); the fourth pulse-width control signal (PWC4) is a signal whose phase is deviated by ½ period from the first pulse-width control signal (PWC1); the fifth pulse-width control signal (PWC5) is a signal whose phase is deviated by ⅔ period from the first pulse-width control signal (PWC1); and the sixth pulse-width control signal (PWC6) is a signal whose phase is deviated by ⅚ period from the first pulse-width control signal (PWC1). Note that here, the ratio of the pulse width of each of the first to fourth clock signals (GCK1 to GCK4) for the scan line driver circuit, to the pulse width of each of the first to sixth pulse-width control signals (PWC1 to PWC6) is 3:2.

In the above-described liquid crystal display device, the same configuration can be applied to the first pulse output circuit 20_1 to the m-th pulse output circuit 20_*m*. However, electrical connections of a plurality of terminals included in the pulse output circuit differ depending on the pulse output circuits. Specific connection relation will be described with reference to FIGS. 2A and 2C.

Figure 2C:
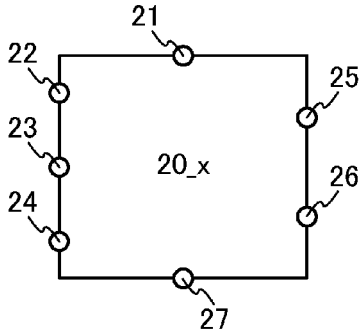
FIG. 2C illustrates a structure example of a pulse output circuit.

Each of the first pulse output circuit 20_1 to the m-th pulse output circuit 20_*m* has terminals 21 to 27 (FIG. 2C). The terminals 21 to 24 and the terminal 26 are input terminals; the terminals 25 and 27 are output terminals.

First, the terminal 21 will be described. The terminal 21 of the first pulse output circuit 20_1 is electrically connected to a wiring for supplying the start signal (GSP) for the scan line driver circuit. The terminals 21 of the second pulse output circuit 20_2 to the m-th pulse output circuit 20_*m* are electrically connected to respective terminals 27 of their respective previous-stage pulse output circuits.

Next, the terminal 22 will be described. The terminal 22 of the (4a−3)-th pulse output circuit (a is a natural number less than or equal to m/4) is electrically connected to the wiring for supplying the first clock signal (GCK1) for the scan line driver circuit. The terminal 22 of the (4a−2)-th pulse output circuit is electrically connected to the wiring for supplying the second clock signal (GCK2) for the scan line driver circuit. The terminal 22 of the (4a−1)-th pulse output circuit is electrically connected to the wiring for supplying the third clock signal (GCK3) for the scan line driver circuit. The terminal 22 of the 4a-th pulse output circuit is electrically connected to the wiring for supplying the fourth clock signal (GCK4) for the scan line driver circuit.

Then, the terminal 23 will be described. The terminal 23 of the (4a−3)-th pulse output circuit is electrically connected to the wiring for supplying the second clock signal (GCK2) for the scan line driver circuit. The terminal 23 of the (4a−2)-th pulse output circuit is electrically connected to the wiring for supplying the third clock signal (GCK3) for the scan line driver circuit. The terminal 23 of the (4a−1)-th pulse output circuit is electrically connected to the wiring for supplying the fourth clock signal (GCK4) for the scan line driver circuit. The terminal 23 of the 4a-th pulse output circuit is electrically connected to the wiring for supplying the first clock signal (GCK1) for the scan line driver circuit.

Next, the terminal 24 will be described. The terminal 24 of the (2b−1)-th pulse output circuit (b is a natural number less than or equal to k/2) is electrically connected to the wiring for supplying the first pulse-width control signal (PWC1). The terminal 24 of the 2b-th pulse output circuit is electrically connected to the wiring for supplying the fourth pulse-width control signal (PWC4). The terminal 24 of the (2c−1)-th pulse output circuit (c is a natural number greater than or equal to (k/2+1) and less than or equal to k) is electrically connected to the wiring for supplying the second pulse-width control signal (PWC2). The terminal 24 of the 2c-th pulse output circuit is electrically connected to the wiring for supplying the fifth pulse-width control signal (PWC5). The terminal 24 of the (2d−1)-th pulse output circuit (d is a natural number greater than or equal to (k+1) and less than or equal to m/2) is electrically connected to the wiring for supplying the third pulse-width control signal (PWC3). The terminal 24 of the 2d-th pulse output circuit is electrically connected to the wiring for supplying the sixth pulse-width control signal (PWC6).

Then, the terminal 25 will be described. The terminal 25 of the x-th pulse output circuit (x is a natural number less than or equal to m) is electrically connected to the scan line 13_*x* in the x-th row.

Next, the terminal 26 will be described. The terminal 26 of the y-th pulse output circuit (y is a natural number less than or equal to m−1) is electrically connected to the terminal 27 of the (y+1)-th pulse output circuit. The terminal 26 of the m-th pulse output circuit is electrically connected to a wiring for supplying a stop signal (STP) for the m-th pulse output circuit. In the case where a (m+1)-th pulse output circuit is provided, the stop signal (STP) for the m-th pulse output circuit corresponds to a signal output from the terminal 27 of the (m+1)-th pulse output circuit. Specifically, the stop signal (STP) for the m-th pulse output circuit can be supplied to the m-th pulse output circuit by the (m+1)-th pulse output circuit provided as a dummy circuit or by inputting the signal directly from the outside.

Connection relation of the terminal 27 of each pulse output circuit is described above. Therefore, the above description is to be referred to.

<Structure Example of Pulse Output Circuit>

Figure 3A:
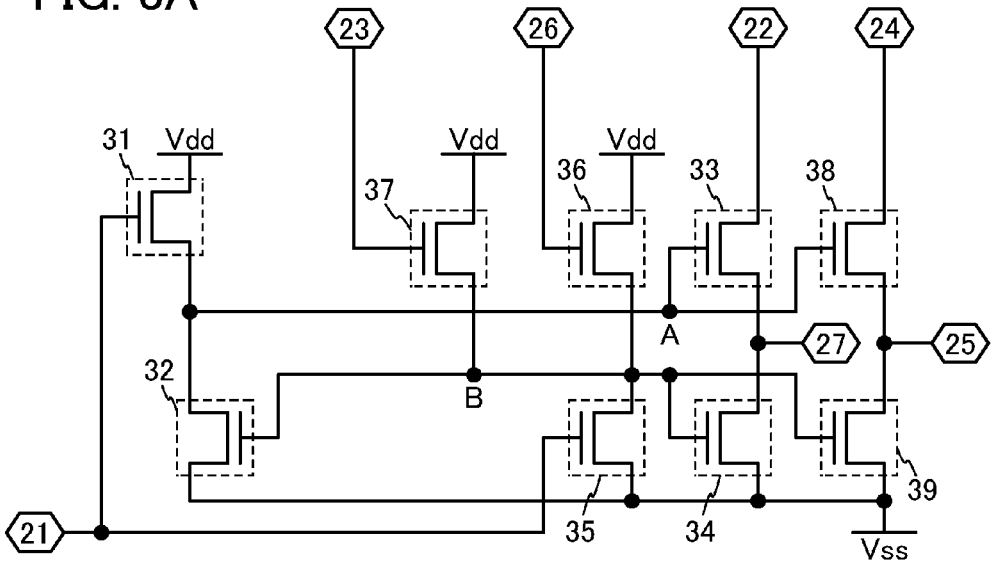
FIG. 3A is a circuit diagram illustrating an example of a pulse output circuit.

FIG. 3A illustrates a structure example of the pulse output circuit illustrated in FIGS. 2A and 2C. A pulse output circuit illustrated in FIG. 3A includes transistors 31 to 39.

One of a source and a drain of the transistor 31 is electrically connected to a wiring for supplying the high power supply potential (Vdd) (hereinafter also referred to as a high power supply potential line). A gate of the transistor 31 is electrically connected to the terminal 21.

One of a source and a drain of the transistor 32 is electrically connected to a wiring for supplying the low power supply potential (Vss) (hereinafter also referred to as a low power supply potential line). The other of the source and the drain of the transistor 32 is electrically connected to the other of the source and the drain of the transistor 31.

One of a source and a drain of the transistor 33 is electrically connected to the terminal 22. The other of the source and the drain of the transistor 33 is electrically connected to the terminal 27. A gate of the transistor 33 is electrically connected to the other of the source and the drain of the transistor 31 and the other of the source and the drain of the transistor 32.

One of a source and a drain of the transistor 34 is electrically connected to the low power supply potential line. The other of the source and the drain of the transistor 34 is electrically connected to the terminal 27. A gate of the transistor 34 is electrically connected to a gate of the transistor 32.

One of a source and a drain of the transistor 35 is electrically connected to the low power supply potential line. The other of the source and the drain of the transistor 35 is electrically connected to the gate of the transistor 32 and the gate of the transistor 34. A gate of the transistor 35 is electrically connected to the terminal 21.

One of a source and a drain of the transistor 36 is electrically connected to the high power supply potential line. The other of the source and the drain of the transistor 36 is electrically connected to the gate of the transistor 32, the gate of the transistor 34, and the other of the source and the drain of the transistor 35. A gate of the transistor 36 is electrically connected to the terminal 26. Note that it is possible to employ a structure in which one of the source and the drain of the transistor 36 is electrically connected to a wiring for supplying a power supply potential (Vcc) which is higher than the low power supply potential (Vss) and lower than the high power supply potential (Vdd).

One of a source and a drain of the transistor 37 is electrically connected to the high power supply potential line. The other of the source and the drain of the transistor 37 is electrically connected to the gate of the transistor 32, the gate of the transistor 34, the other of the source and the drain of the transistor 35, and the other of the source and the drain of the transistor 36. A gate of the transistor 37 is electrically connected to the terminal 23. Note that it is possible to employ a structure in which one of the source and the drain of the transistor 37 is electrically connected to a wiring for supplying the power supply potential (Vcc).

One of a source and a drain of the transistor 38 is electrically connected to the terminal 24. The other of the source and the drain of the transistor 38 is electrically connected to the terminal 25. A gate of the transistor 38 is electrically connected to the other of the source and the drain of the transistor 31, the other of the source and the drain of the transistor 32, and the gate of the transistor 33.

One of a source and a drain of the transistor 39 is electrically connected to the low power supply potential line. The other of the source and the drain of the transistor 39 is electrically connected to the terminal 25. A gate of the transistor 39 is electrically connected to the gate of the transistor 32, the gate of the transistor 34, the other of the source and the drain of the transistor 35, the other of the source and the drain of the transistor 36, and the other of the source and the drain of the transistor 37.

In the following description, a node where the other of the source and the drain of the transistor 31, the other of the source and the drain of the transistor 32, the gate of the transistor 33, and the gate of the transistor 38 are electrically connected to each other is referred to as a node A; a node where the gate of the transistor 32, the gate of the transistor 34, the other of the source and the drain of the transistor 35, the other of the source and the drain of the transistor 36, the other of the source and the drain of the transistor 37, and the gate of the transistor 39 are electrically connected to each other is referred to as a node B.

<Operation Example of Pulse Output Circuit>

Figure 3B:
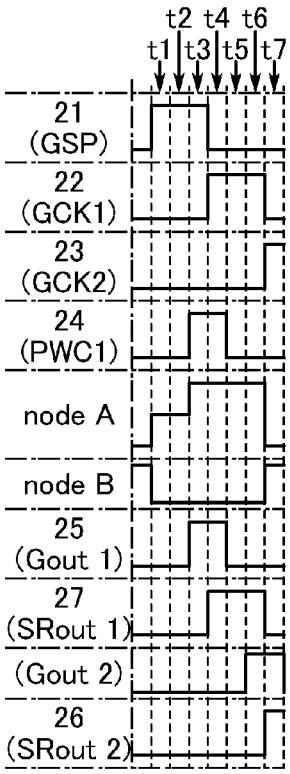
FIGS. 3B to 3D are timing diagrams each illustrating an operation example of the pulse output circuit.
Figure 3C:
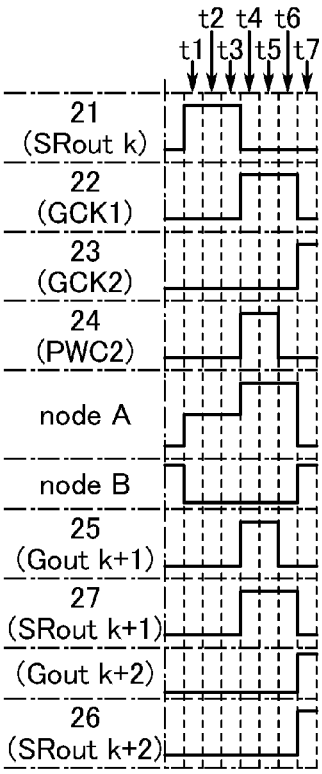
Figure 3D:
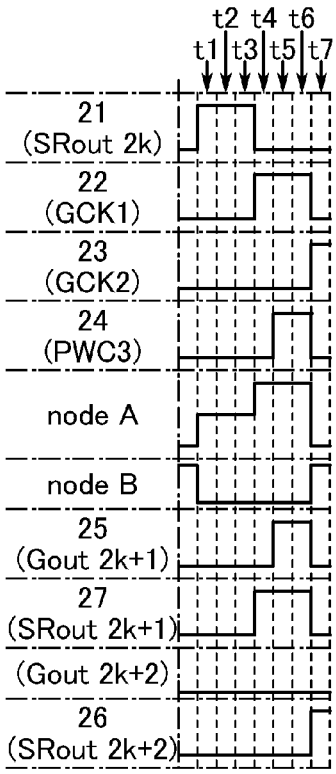

An operation example of the above-described pulse output circuit will be described with reference to FIGS. 3B to 3D. Described here is an operation example in the case where timing of inputting the start pulse (GSP) for the scan line driver circuit to the terminal 21 of the first pulse output circuit 20_1 is controlled such that shift pulses are output from the terminals 27 of the first pulse output circuit 20_1, the (k+1)-th pulse output circuit 20_(k+1), and the (2k+1)-th pulse output circuit 20_(2k+1) at the same timing. Specifically, the potentials of the signals which are input to the terminals of the first pulse output circuit 20_1 and the potentials of the node A and the node B when the start pulse (GSP) for the scan line driver circuit is input are illustrated in FIG. 3B; the potentials of the signals which are input to the terminals of the (k+1)-th pulse output circuit 20_(k+1) and the potentials of the node A and the node B when the high-level potential is input from the k-th pulse output circuit 20_*k* are illustrated in FIG. 3C; and the potentials of the signals which are input to the terminals of the (2k+1)-th pulse output circuit 20_(2k+1) and the potentials of the node A and the node B when the high-level potential is input from the 2k-th pulse output circuit 20_2k are illustrated in FIG. 3D. In FIGS. 3B to 3D, the signals which are input to the terminals are each provided in parentheses. In addition, the signal (Gout 2, Gout k+2, Gout 2k+2) which is output from the terminal 25 of the subsequent-stage pulse output circuit (the second pulse output circuit 20_2, the (k+2)-th pulse output circuit 20_(k+2), the (2k+2)-th pulse output circuit 20_(2k+2)), and a signal output from the terminal 27 of the subsequent-stage pulse output circuit (SRout 2: input signal of the terminal 26 of the first pulse output circuit 20_1, SRout k+2: input signal of the terminal 26 of the (k+1)-th pulse output circuit 20_(k+1), SRout 2k+2: input signal of the terminal 26 of the (2k+1)-th pulse output circuit 20_(2k+1)) are also illustrated. Note that in FIGS. 3B to 3D, Gout represents an output signal from the pulse output circuit to the scan line, and SRout represents an output signal from the pulse output circuit to the pulse output circuits of the previous stage and the subsequent stage.

First, the case where the high-level potential is input as the start pulse (GSP) for the scan line driver circuit to the first pulse output circuit 20_1 will be described with reference to FIG. 3B.

In a period t1, the high-level potential (high power supply potential (Vdd)) is input to the terminal 21. Thus, the transistors 31 and 35 are turned on. As a result, the potential of the node A is increased to the high-level potential (potential that is decreased from the high power supply potential (Vdd) by the threshold voltage of the transistor 31), and the potential of the node B is decreased to the low power supply potential (Vss), so that the transistors 33 and 38 are turned on and the transistors 32, 34, and 39 are turned off. Thus, in the period t1, a signal output from the terminal 27 is a signal input to the terminal 22, and a signal output from the terminal 25 is a signal input to the terminal 24. Here in the period t1, both the signal input to the terminal 22 and the signal input to the terminal 24 are the low-level potential (low power supply potential (Vss)). Accordingly, in the period t1, the first pulse output circuit 20_1 outputs the low-level potential (low power supply potential (Vss)) to the terminal 21 of the second pulse output circuit 20_2 and the scan line in the first row in the pixel portion.

In a period t2, the levels of the signals input to the terminals are the same as in the period t1. Therefore, the potentials of the signals output from the terminals 25 and 27 are also not changed; the low-level potentials (low power supply potentials (Vss)) are output.

In a period t3, the high-level potential (high power supply potential (Vdd)) is input to the terminal 24. Note that the potential of the node A (the source potential of the transistor 31) has been increased to the high-level potential (potential that is decreased from the high power supply potential (Vdd) by the threshold voltage of the transistor 31) in the period t1. Therefore, the transistor 31 is turned off. At this time, the input of the high-level potential (high power supply potential (Vdd)) to the terminal 24 further increases the potential of the node A (the potential of the gate of the transistor 38) by capacitive coupling between the source and the gate of the transistor 38 (bootstrapping). Owing to the bootstrapping, the potential of the signal output from the terminal 25 is not decreased from the high-level potential (high power supply potential (Vdd)) input to the terminal 24. Accordingly, in the period t3, the first pulse output circuit 20_1 outputs the high-level potential (high power supply potential (Vdd)=a selection signal) to the scan line in the first row in the pixel portion.

In a period t4, the high-level potential (high power supply potential (Vdd)) is input to the terminal 22. As a result, since the potential of the node A has been increased by the bootstrapping, the potential of the signal output from the terminal 27 is not decreased from the high-level potential (high power supply potential (Vdd)) input to the terminal 22. Accordingly, in the period t4, the terminal 27 outputs the high-level potential (high power supply potential (Vdd)) which is input to the terminal 22. In other words, the first pulse output circuit 20_1 outputs the high-level potential (high power supply potential (Vdd)=a shift pulse) to the terminal 21 of the second pulse output circuit 20_2. In the period t4 also, the signal input to the terminal 24 maintains the high-level potential (high power supply potential (Vdd)), so that the signal output to the scan line in the first row in the pixel portion from the first pulse output circuit 20 1 remains at the high-level potential (high power supply potential (Vdd)=the selection signal). Further, the low-level potential (low power supply potential (Vss)) is input to the terminal 21 to turn off the transistor 35, which does not directly influence the output signal of the pulse output circuit in the period t4.

In a period t5, the low-level potential (low power supply potential (Vss)) is input to the terminal 24. In that period, the transistor 38 maintains the on state. Accordingly, in the period t5, the first pulse output circuit 20_1 outputs the low-level potential (low power supply potential (Vss)) to the scan line arranged in the first row in the pixel portion.

In a period t6, the levels of the signals input to the terminals are the same as in the period t5. Therefore, the potentials of the signals output from the terminals 25 and 27 are also not changed; the low-level potential (low power supply potentials (Vss)) is output from the terminal 25 and the high-level potential (high power supply potential (Vdd)=the shift pulse) is output from the terminal 27.

In a period t7, the high-level potential (high power supply potential (Vdd)) is input to the terminal 23. Thus, the transistor 37 is turned on. As a result, the potential of the node B is increased to the high-level potential (potential that is decreased from the high power supply potential (Vdd) by the threshold voltage of the transistor 37). In other words, the transistors 32, 34, and 39 are turned on. On the other hand, the potential of the node A is decreased to the low-level potential (low power supply potential (Vss)). In other words, the transistors 33 and 38 are turned off. Accordingly, in the period t7, both of the signals output from the terminals 25 and 27 are at the low power supply potentials (Vss). In other words, in the period t7, the first pulse output circuit 20_1 outputs the low power supply potential (Vss) to the terminal 21 of the second pulse output circuit 20_2 and the scan line arranged in the first row in the pixel portion.

Next, the case where the high-level potential is input as the shift pulse from the k-th pulse output circuit 20_*k* to the terminal 21 of the (k+1)-th pulse output circuit 20_(k+1) will be described with reference to FIG. 3C.

Operation of the (k+1)-th pulse output circuit 20_(k+1) is as of the first pulse output circuit 20_1 in the periods t1 and t2. Therefore, the above description is to be referred to.

In the period t3, the levels of the signals input to the terminals are the same as in the period t2. Therefore, the potentials of the signals output from the terminals 25 and 27 are also not changed; the low-level potentials (low power supply potentials (Vss)) are output.

In the period t4, the high-level potentials (high power supply potentials (Vdd)) are input to the terminals 22 and 24. Note that the potential of the node A (the source potential of the transistor 31) has been increased to the high-level potential (potential that is decreased from the high power supply potential (Vdd) by the threshold voltage of the transistor 31) in the period t1. Therefore, the transistor 31 is off in the period t1. The input of the high-level potentials (high power supply potentials (Vdd)) to the terminals 22 and 24 further increases the potential of the node A (the potentials of the gates of the transistors 33 and 38) by capacitive coupling between the source and the gate of the transistor 33 and capacitive coupling between the source and the gate of the transistor 38 (bootstrapping). Owing to the bootstrapping, the potentials of the signals output from the terminals 25 and 27 are not decreased from the high-level potentials (high power supply potentials (Vdd)) input to the terminals 22 and 24, respectively. Accordingly, in the period t4, the (k+1)-th pulse output circuit 20_(k+1) outputs the high-level potentials (high power supply potentials (Vdd)=a selection signal and a shift pulse) to the scan line in the (k+1)-th row in the pixel portion and the terminal 21 of the (k+2)-th pulse output circuit 20_(k+2).

In the period t5, the levels of the signals input to the terminals are the same as in the period t4. Therefore, the potentials of the signals output from the terminals 25 and 27 are also not changed; the high-level potentials (high power supply potentials (Vdd)=the selection signal and the shift pulse) are output.

In the period t6, the low-level potential (low power supply potential (Vss)) is input to the terminal 24. In that period, the transistor 38 maintains the on state. Accordingly, in the period t6, the (k+1)-th pulse output circuit 20_(k+1) outputs the low-level potential (low power supply potential (Vss)) to the scan line arranged in the (k+1)-th row in the pixel portion.

In the period t7, the high-level potential (high power supply potential (Vdd)) is input to the terminal 23. Thus, the transistor 37 is turned on. As a result, the potential of the node B is increased to the high-level potential (potential that is decreased from the high power supply potential (Vdd) by the threshold voltage of the transistor 37). In other words, the transistors 32, 34, and 39 are turned on. On the other hand, the potential of the node A is decreased to the low-level potential (low power supply potential (Vss)). In other words, the transistors 33 and 38 are turned off. Accordingly, in the period t7, both of the signals output from the terminals 25 and 27 are at the low power supply potentials (Vss). In other words, in the period t7, the (k+1)-th pulse output circuit 20_(k+1) outputs the low power supply potential (Vss) to the terminal 21 of the (k+2)-th pulse output circuit 20_(k+2) and the scan line arranged in the (k+1)-th row in the pixel portion.

Next, the case where the high-level potential is input as the shift pulse from the 2k-th pulse output circuit 20_2k to the terminal 21 of the (2k+1)-th pulse output circuit 20_(2k+1) will be described below with reference to FIG. 3D.

Operation of the (2k+1)-th pulse output circuit 20_(2k+1) is as of the (k+1)-th pulse output circuit 20_(k+1) in the periods t1 to t3. Therefore, the above description is to be referred to.

In the period t4, the high-level potential (high power supply potential (Vdd)) is input to the terminal 22. Note that the potential of the node A (the source potential of the transistor 31) has been increased to the high-level potential (potential that is decreased from the high power supply potential (Vdd) by the threshold voltage of the transistor 31) in the period t1. Therefore, the transistor 31 is turned off in the period t1. The input of the high-level potential (high power supply potential (Vdd)) to the terminal 22 further increases the potential of the node A (the potential of the gate of the transistor 33) by capacitive coupling between the source and the gate of the transistor 33 (bootstrapping). Owing to the bootstrapping, the potential of the signal output from the terminal 27 is not decreased from the high-level potential (high power supply potential (Vdd)) input to the terminal 22. Accordingly, in the period t4, the (2k+1)-th pulse output circuit 20_(2k+1) outputs the high-level potential (high power supply potential (Vdd)=a shift pulse) to the terminal 21 of the (2k+2)-th pulse output circuit 20_(2k+2). Further, the low-level potential (low power supply potential (Vss)) is input to the terminal 21 to turn off the transistor 35, which does not directly influence the output signal of the pulse output circuit in the period t4.

In the period t5, the high-level potential (high power supply potential (Vdd)) is input to the terminal 24. As a result, since the potential of the node A has been increased by the bootstrapping, the potential of the signal output from the terminal 25 is not decreased from the high-level potential (high power supply potential (Vdd)) input to the terminal 24. Accordingly, in the period t5, the terminal 25 outputs the high-level potential (high power supply potential (Vdd)) which is input to the terminal 22. In other words, the (2k+1)-th pulse output circuit 20_(2k+1) outputs the high-level potential (high power supply potential (Vdd)=a selection signal) to the scan line arranged in the (2k+1)-th row in the pixel. In the period t5 also, the signal input to the terminal 22 maintains the high-level potential (high power supply potential (Vdd)), so that the signal output from the (2k+1)-th pulse output circuit 20_(2k+1) to the terminal 21 of the (2k+2)-th pulse output circuit 20_(2k+2) remains at the high-level potential (high power supply potential (Vdd)=the shift pulse).

In the period t6, the levels of the signals input to the terminals are the same as in the period t5. Therefore, the potentials of the signals output from the terminals 25 and 27 are also not changed; the high-level potentials (high power supply potentials (Vdd)=the selection signal and the shift pulse) are output.

In the period t7, the high-level potential (high power supply potential (Vdd)) is input to the terminal 23. Thus, the transistor 37 is turned on. As a result, the potential of the node B is increased to the high-level potential (potential that is decreased from the high power supply potential (Vdd) by the threshold voltage of the transistor 37). In other words, the transistors 32, 34, and 39 are turned on. On the other hand, the potential of the node A is decreased to the low-level potential (low power supply potential (Vss)). In other words, the transistors 33 and 38 are turned off. Accordingly, in the period t7, both of the signals output from the terminals 25 and 27 are the low power supply potential (Vss). In other words, in the period t7, the (2k+1)-th pulse output circuit 20_(2k+1) outputs the low power supply potential (Vss) to the terminal 21 of the (2k+2)-th pulse output circuit 20_(2k+2) and the scan line arranged in the (2k+1)-th row in the pixel portion.

As illustrated in FIGS. 3B to 3D, with the first pulse output circuit 20_1 to the m-th pulse output circuit 20_*m*, a plurality of shift pulses can be shifted in parallel by controlling the timing of inputting the start pulse (GSP) for the scan line driver circuit. Specifically, after the start pulse (GSP) for the scan line driver circuit is input, the start pulse (GSP) for the scan line driver circuit is input again at the timing at which the terminal 27 of the k-th pulse output circuit 20_*k* outputs a shift pulse, whereby shift pulses can be output from the first pulse output circuit 20_1 and the (k+1)-th pulse output circuit 20 (k+1) at the same timing. The start pulse (GSP) for the scan line driver circuit can be further input in a similar manner, whereby shift pulses can be output from the first pulse output circuit 20_1, the (k+1)-th pulse output circuit 20_(k+1), and the (2k+1)-th pulse output circuit 20_(2k+1) at the same timing.

In addition, the first pulse output circuit 20_1, the (k+1)-th pulse output circuit 20_(k+1), and the (2k+1)-th pulse output circuit 20_(2k+1) can supply selection signals to respective scan lines at different timings in parallel to the above-described operation. In other words, with the scan line driver circuit, a plurality of shift pulses including a specific shift period can be shifted, and a plurality of pulse output circuits to which shift pulses are input at the same timing can supply selection signals to their respective scan lines at different timings.

<Structure Example of Signal Line Driver Circuit 12>

Figure 4A:
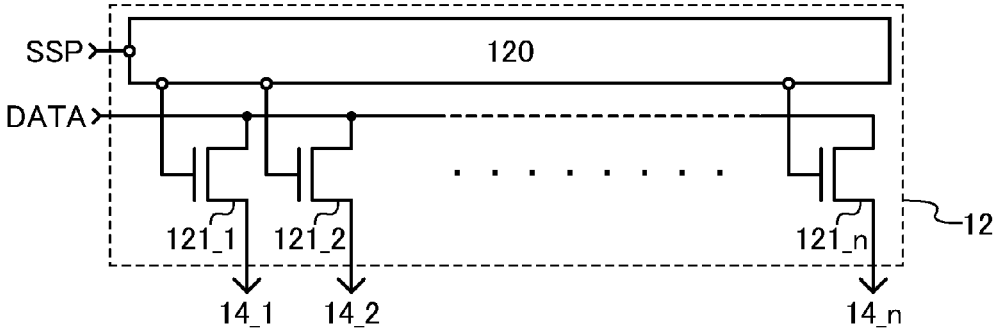
FIG. 4A illustrates a structure example of a signal line driver circuit.

FIG. 4A illustrates a structure example of the signal line driver circuit 12 included in the liquid crystal display device in FIG. 1A. The signal line driver circuit 12 illustrated in FIG. 4A includes a shift register 120 having first to n-th output terminals, a wiring for supplying an image signal (DATA), and transistors 121_1 to 121_*n*. One of a source and a drain of the transistor 121_1 is electrically connected to the wiring for supplying the image signal (DATA), the other of the source and the drain of the transistor 121_1 is electrically connected to the signal line 14_1 in the first column in the pixel portion, and a gate of the transistor 121_1 is electrically connected to the first output terminal of the shift register 120. One of a source and a drain of the transistor 121_*n* is electrically connected to the wiring for supplying the image signal (DATA), the other of the source and the drain of the transistor 121_*n* is electrically connected to the signal line 14_*n* in the n-th column in the pixel portion, and a gate of the transistor 121_*n* is electrically connected to the n-th output terminal of the shift register 120. The shift register 120 outputs the high-level potential sequentially from the first to n-th output terminals per shift period, when a high-level potential is input as a start pulse for the signal line driver circuit (SSP). In other words, the transistors 121_1 to 121_*n* are sequentially turned on per shift period.

Figure 4B:
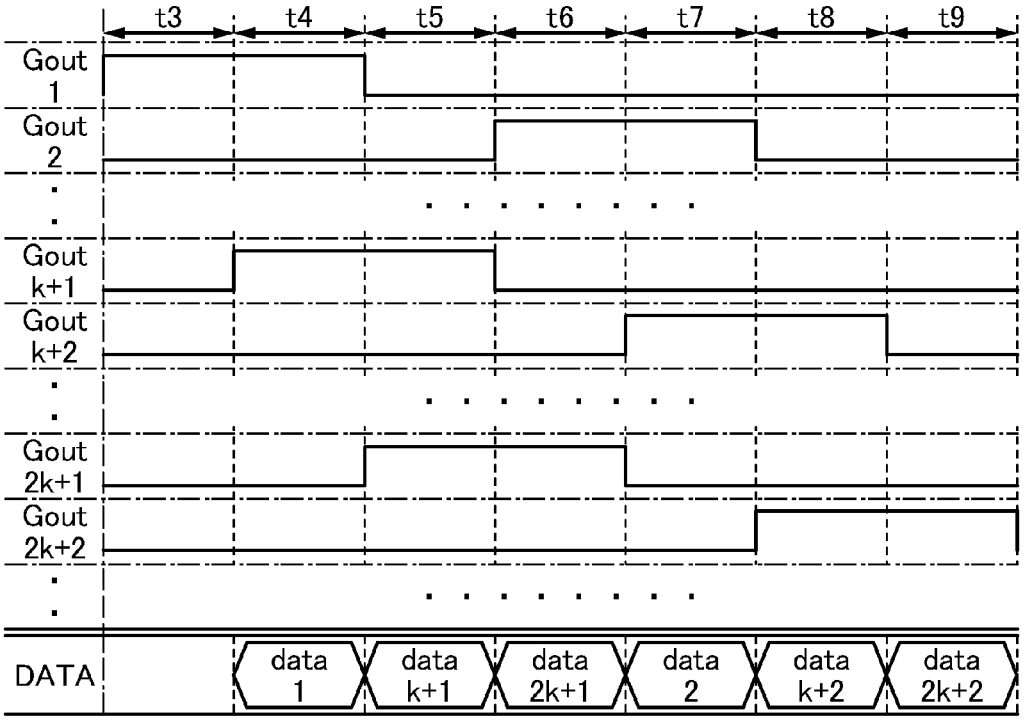
FIG. 4B illustrates an operation example of the signal line driver circuit.

FIG. 4B illustrates an example of timing of image signals which are supplied through the wiring for supplying the image signal (DATA). As illustrated in FIG. 4B, the wiring for supplying the image signal (DATA) supplies an image signal for a pixel provided in the first row (data 1) in the period t4; an image signal for a pixel provided in the (k+1)-th row (data k+1) in the period t5; an image signal for a pixel provided in the (2k+1)-th row (data 2k+1) in the period t6; and an image signal for a pixel provided in the second row (data 2) in the period t7. In this manner, the wiring for supplying the image signal (DATA) supplies image signals for pixels arranged in respective rows sequentially. Specifically, image signals are supplied in the following order: an image signal for a pixel provided in the s-th row (s is a natural number less than k)→an image signal for a pixel provided in the (k+s)-th row→an image signal for a pixel provided in the (2k+s)-th row→an image signal for a pixel provided in the (s+1)-th row. According to the above-described operation of the scan line driver circuit and the signal line driver circuit, the image signals can be input to the pixels in three rows provided in the pixel portion per shift period of the pulse output circuit in the scan line driver circuit. In other words, when the operation is performed by the scan line driver circuit and the signal line driver circuit, the plurality of pixels arranged in the m rows and the n columns can be subjected to scanning of three kinds of image signals in parallel.

<Structure Example of Backlight>

Figure 5:
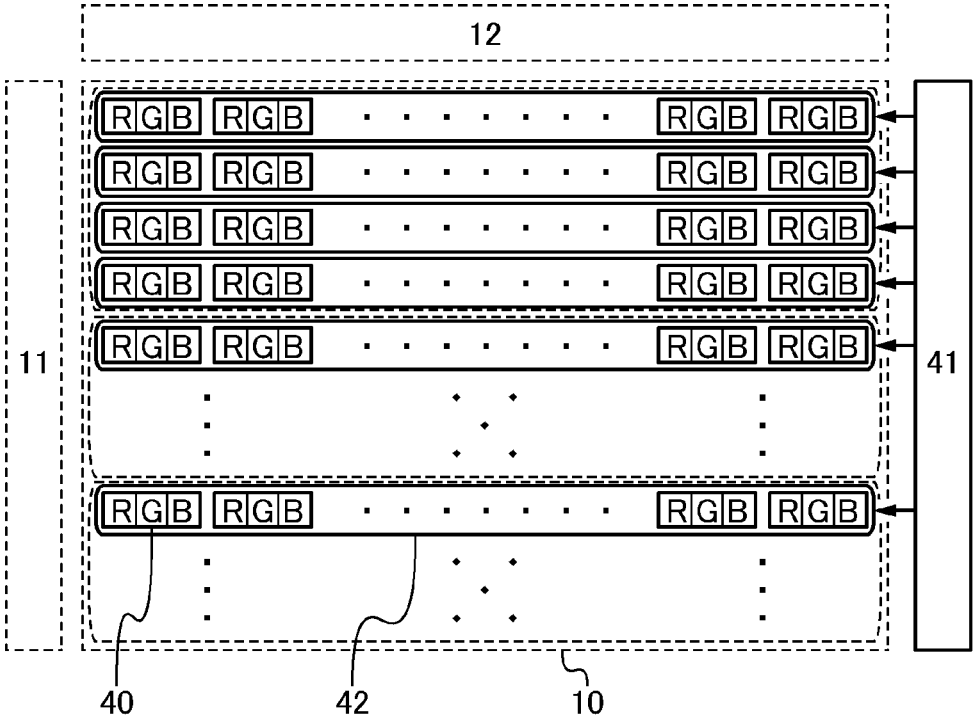
FIG. 5 illustrates a structure example of a backlight.

FIG. 5 illustrates a structure example of a backlight provided behind the pixel portion 10 in the liquid crystal display device illustrated in FIG. 1A. The backlight illustrated in FIG. 5 includes a plurality of backlight units 40 arranged in a matrix. Note that each backlight unit 40 includes a light source that emits red (R) light, a light source that emits green (G) light, and a light source that emits blue (B) light. In addition, on/off of the light sources in the plurality of backlight units 40 is controlled by a backlight control circuit 41. Note that here, the backlight control circuit 41 can control on/off of the light sources with respect to each backlight unit group 42 which is used for irradiating pixels arranged in t rows and n columns (here, t is k/4) with light among the plurality of pixels arranged in m rows and n columns. In other words, the backlight control circuit 41 can independently control light emitted in the backlight unit group for the first to t-th rows to the backlight unit group for the (2k+3t+1)-th to m-th rows. Further, the backlight control circuit 41 can make any one of three kinds of light sources included in the backlight units 40 in the backlight unit group 42 turn on, make any two of the light sources turn on at the same time, or make all light sources turn on at the same time. Note that in the case where all three kinds of light sources turn on at the same time, the backlight unit 40 emits white (W) light. As the light source, a light-emitting diode (LED) or the like can be applied.

<Operation Example of Liquid Crystal Display Device>

Figure 6:
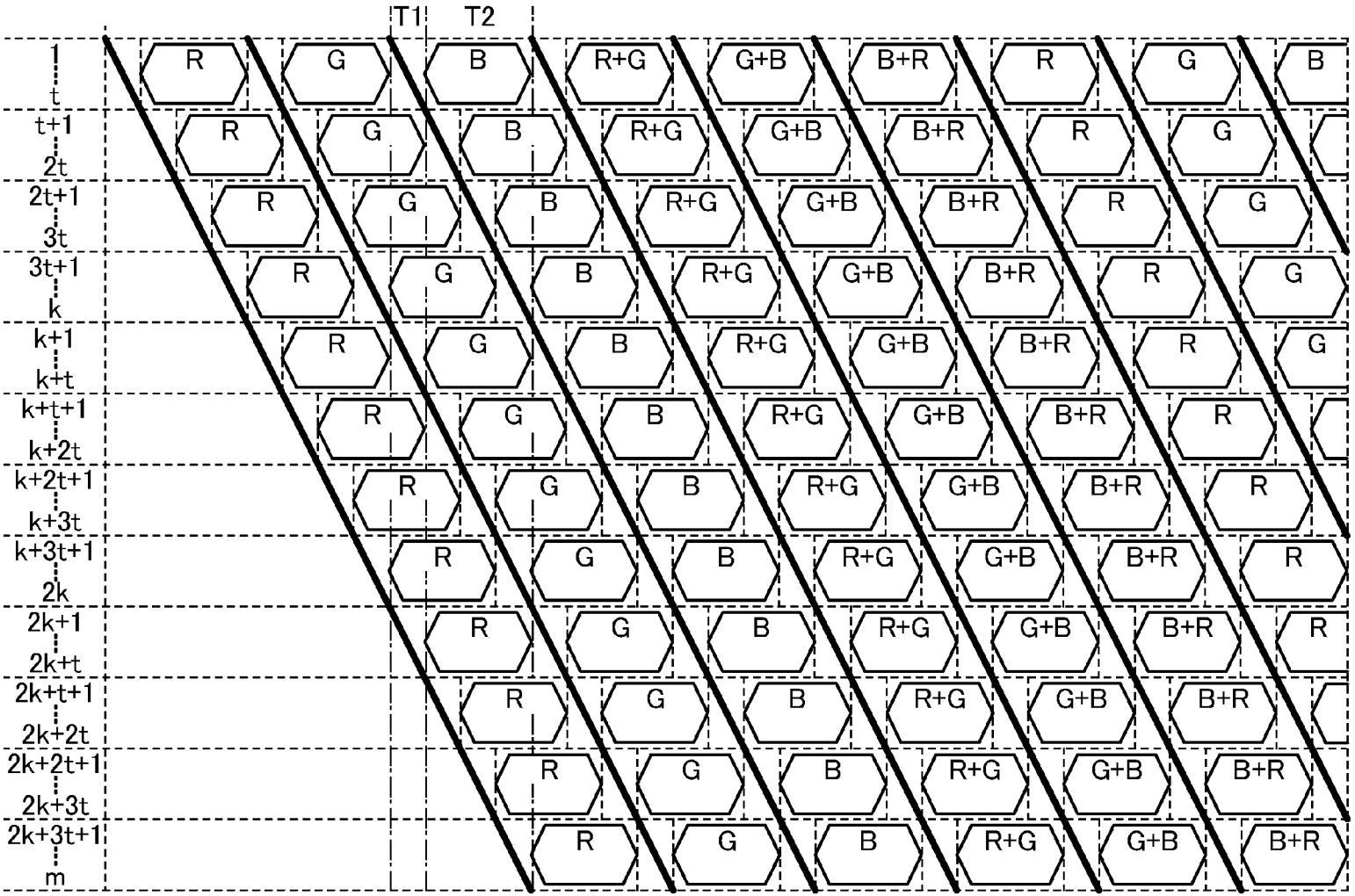
FIG. 6 illustrates an operation example of a liquid crystal display device.

FIG. 6 illustrates the timing of scanning of an image signal in the above-described liquid crystal display device and timing of light emitted in the backlight unit group for the first to t-th rows to the backlight unit group for the (2k+3t+1)-th to m-th rows included in the backlight. Note that the vertical axis represents rows (first to m-th rows) in the pixel portion, and the horizontal axis represents time in FIG. 6. In the above-described liquid crystal display device, image signals are not sequentially input to the pixels arranged in the first to the m-th rows but are sequentially input to the rows which are spaced by k rows (e.g., in the following order: the pixel provided in the first row→the pixel provided in the (k+1)-th row→the pixel provided in the (2k+1)-th row→the pixel provided in the second row). Thus, in a period T1, the scanning of the image signals for controlling transmission of blue (B) light with respect to the n pixels arranged in the first row to the n pixels arranged in the t-th row, the scanning of the image signals for controlling transmission of green (G) light with respect to the n pixels arranged in the (k+1)-th row to the n pixels arranged in the (k+t)-th row, and the scanning of the image signals for controlling transmission of red (R) light with respect to the n pixels arranged in the (2k+1)-th row to the n pixels arranged in the (2k+t)-th row can be performed in parallel.

Further, in the liquid crystal display device as in FIG. 6, in a period T2, the blue (B) light source can be turned on in the backlight unit group for the first to t-th rows, the green (G) light source can be turned on in the backlight unit group for the (k+1)-th to (k+t)-th rows, and the red (R) light source can be turned on in the backlight unit group for the (2k+1)-th to (2k+t)-th rows. Note that in the period T2, the scanning of the image signals for controlling transmission of blue (B) light with respect to the n pixels arranged in the (t+1)-th row to the n pixels arranged in the k-th row, the scanning of the image signals for controlling transmission of green (G) light with respect to the n pixels arranged in the (k+t+1)-th row to the n pixels arranged in the 2k-th row, and the scanning of the image signals for controlling transmission of red (R) light with respect to the n pixels arranged in the (2k+t+1)-th row to the n pixels arranged in the m-th row can be performed in parallel.

Note that in the operation example illustrated in FIG. 6, an image is formed in the pixel portion by the operation from the input of the image signals for controlling transmission of red (R) light to light emission of the blue (B) light with respect to each pixel. In other words, the image is formed using red (R) light, green (G) light, and blue (B) light.

Further, in the operation example illustrated in FIG. 6, an image formed in the pixel portion following the image is formed using mixed color light formed by a mixture of red (R) light and green (G) light, mixed color light formed by a mixture of green (G) light and blue (B) light, and mixed color light formed by a mixture of blue (B) light and red (R) light.

<Liquid Crystal Display Device Disclosed in this Specification>

The liquid crystal display device disclosed in this specification can perform the scanning of an image signal and the turning on a light source in a backlight unit group in parallel. Therefore, it is possible to increase the frequency of input of an image signal to each pixel of the liquid crystal display device. Accordingly, color break generated in a field-sequential liquid crystal display device can be suppressed, and the quality of an image displayed by the liquid crystal display device can be improved.

The liquid crystal display device disclosed in this specification can achieve the above-mentioned operation while having a simple pixel configuration. Specifically, for a pixel of the liquid crystal display device disclosed in Patent Document 1, the transistor for controlling charge transfer is necessary in addition to the components of the pixel of the liquid crystal display device disclosed in this specification. Further, a signal line for controlling on/off of the transistor is also required. In contrast, a pixel configuration of the liquid crystal display device disclosed in this specification is simple. In other words, the liquid crystal display device disclosed in this specification can increase the aperture ratio of a pixel, as compared to the liquid crystal display device disclosed in Patent Document 1. Further, the number of wirings extending to a pixel portion is small, so that parasitic capacitance generated between various wirings can be decreased. In other words, various wirings extending to the pixel portion can operate at high speed.

Further, in the case where the backlight is turned on as the operation example in FIG. 6, colors of lights of backlight unit groups adjacent to each other are not different from each other. Specifically, when the backlight unit group is turned on in a region where the scanning of the image signal is performed in the period T1, which follows the scanning, colors of lights of backlight unit groups adjacent to each other are not different from each other. For example, in the period T1, when the backlight unit group for the (k+1)-th to (k+t)-th rows emits green (G) light after the scanning of the image signals for controlling transmission of green (G) light with respect to the n pixels arranged in the (k+1)-th row to the n pixels arranged in the (k+t)-th row is terminated, the light source that emits green (G) light is turned on or emission itself is not performed (neither red (R) light nor blue (B) light is emitted) in the backlight unit group for the (3t+1)-th to k-th rows and the backlight unit group for the (k+t+1)-th to (k+2t)-th rows. Thus, the probability of transmission of light of a color different from a given color through a pixel to which image data on the given color is input can be reduced.

In the case where an image formed in such a manner that any two light sources in different combinations of the three light sources included in the backlight unit are sequentially turned on is included in images displayed by the liquid crystal display device as in the operation example in FIG. 6, it is possible to improve display luminance of the liquid crystal display device. Further, a lighting period of each of a plurality of light sources included in the backlight unit is ensured for a long period, whereby display color tones of the liquid crystal display device can be subdivided (shades of color to be displayed or the like can be expressed more finely).

<Modification Example>

The liquid crystal display device described above is one embodiment of the present invention, and the present invention includes a liquid crystal display device which is different from the above-described liquid crystal display device.

For example, the liquid crystal display device described above has a structure in which the pixel portion 10 is divided into three regions and image signals are supplied in parallel to the three regions; however, a liquid crystal display device according to one embodiment of the present invention is not limited to the structure. In other words, the liquid crystal display device according to one embodiment of the present invention can have a structure in which the pixel portion 10 is divided into a plurality of regions the number of which is not three and image signals are supplied in parallel to the plurality of regions. In the case where the number of regions is changed, it is necessary to set clock signals for the scan line driver circuit and pulse-width control signals in accordance with the number of regions, or the like.

The liquid crystal display device described above includes a capacitor for retaining voltage applied to a liquid crystal element (see FIG. 1B); however, it is possible not to include the capacitor. In this case, the aperture ratio of the pixel can be increased. Since a capacitor wiring extending to a pixel portion can be removed, various wirings extending to the pixel portion can operate at high speed.

Figure 7A:
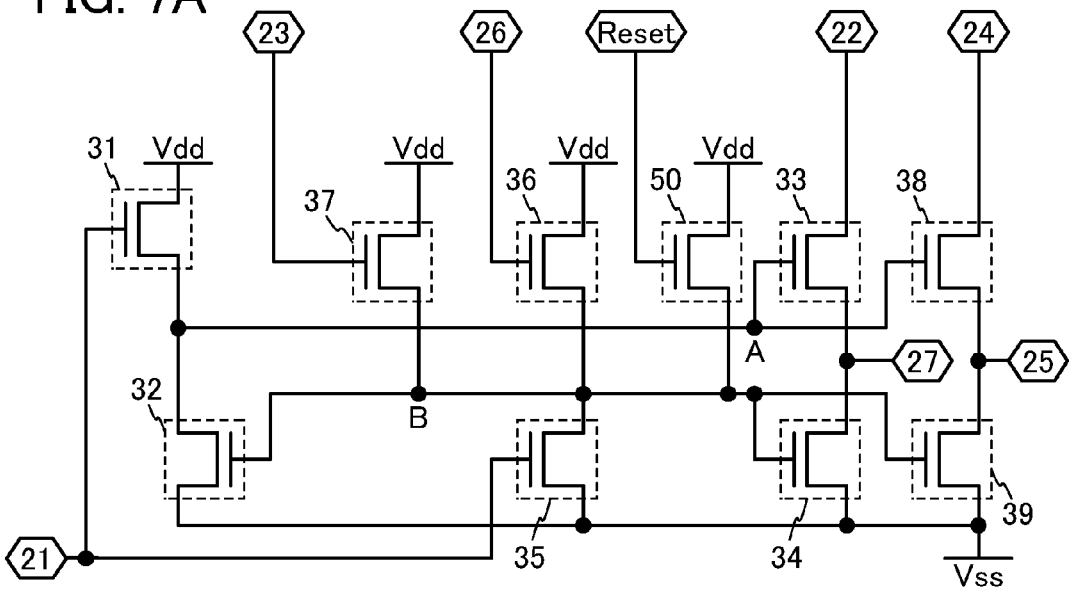
FIGS. 7A and 7B are circuit diagrams each illustrating an example of a pulse output circuit.

Further, the pulse output circuit can have a structure in which a transistor 50 is added to the pulse output circuit illustrated in FIG. 3A (see FIG. 7A). One of a source and a drain of the transistor 50 is electrically connected to the high power supply potential line; the other of the source and the drain of the transistor 50 is electrically connected to the gate of the transistor 32, the gate of the transistor 34, the other of the source and the drain of the transistor 35, the other of the source and the drain of the transistor 36, the other of the source and the drain of the transistor 37, and the gate of the transistor 39; and a gate of the transistor 50 is electrically connected to a reset terminal (Reset). To the reset terminal, the high-level potential is input in a period after an image is formed in the pixel portion; the low-level potential is input in the other period. Note that the high-level potential is input, whereby the transistor 50 is turned on. Thus, the potential of each node can be initialized, so that malfunction can be prevented. Note that in the case where the initialization is performed, it is necessary to provide an initialization period after the period in which an image is formed in the pixel portion. In the case where a period in which the backlight is turned off is provided after the period in which an image is formed in the pixel portion, which is to be described later with reference to FIG. 9, the initialization can be performed in the period in which the backlight is turned off.

Figure 7B:
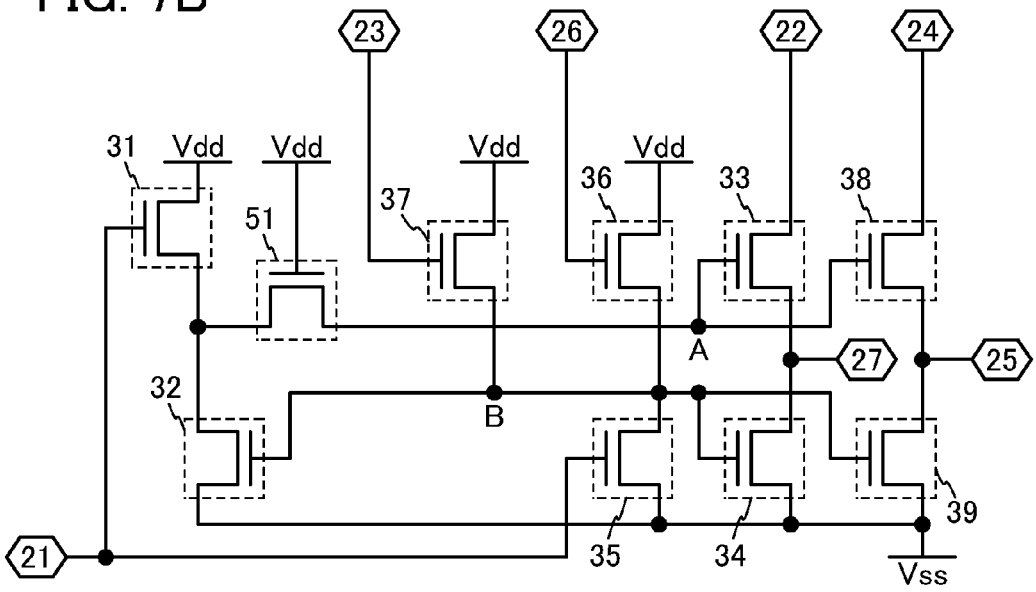

Further alternatively, the pulse output circuit can have a structure in which a transistor 51 is added to the pulse output circuit illustrated in FIG. 3A (see FIG. 7B). One of a source and a drain of the transistor 51 is electrically connected to the other of the source and the drain of the transistor 31 and the other of the source and the drain of the transistor 32; the other of the source and the drain of the transistor 51 is electrically connected to the gate of the transistor 33 and the gate of the transistor 38; and a gate of the transistor 51 is electrically connected to the high power supply potential line. The transistor 51 is turned off in a period in which the potential of the node A is at a high level (the periods t1 to t6 in FIGS. 3B to 3D). With the transistor 51, the gate of the transistor 33 and the gate of the transistor 38 can be electrically disconnected to the other of the source and the drain of the transistor 31 and the other of the source and the drain of the transistor 32 in the periods t1 to t6. Thus, a load at the time of the bootstrapping in the pulse output circuit can be reduced in the periods t1 to t6.

Figure 8A:
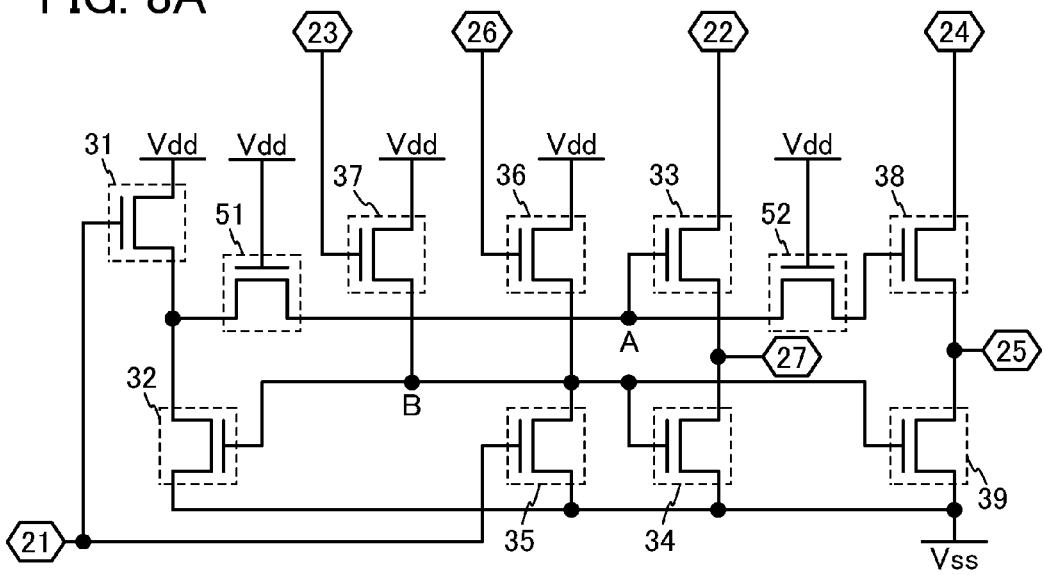
FIGS. 8A and 8B are circuit diagrams each illustrating an example of a pulse output circuit.

Further alternatively, the pulse output circuit can have a structure in which a transistor 52 is added to the pulse output circuit illustrated in FIG. 7B (see FIG. 8A). One of a source and a drain of the transistor 52 is electrically connected to the gate of the transistor 33 and the other of the source and the drain of the transistor 51; the other of the source and the drain of the transistor 52 is electrically connected to the gate of the transistor 38; and a gate of the transistor 52 is electrically connected to the high power supply potential line. As described above, a load at the time of the bootstrapping in the pulse output circuit can be reduced with the transistor 52. An effect due to a decrease in loads, in particular, in the case where the potential of the node A in the pulse output circuit is increased only by capacitive coupling between the source and the gate of the transistor 33 (see FIG. 3D), is great.

Figure 8B:
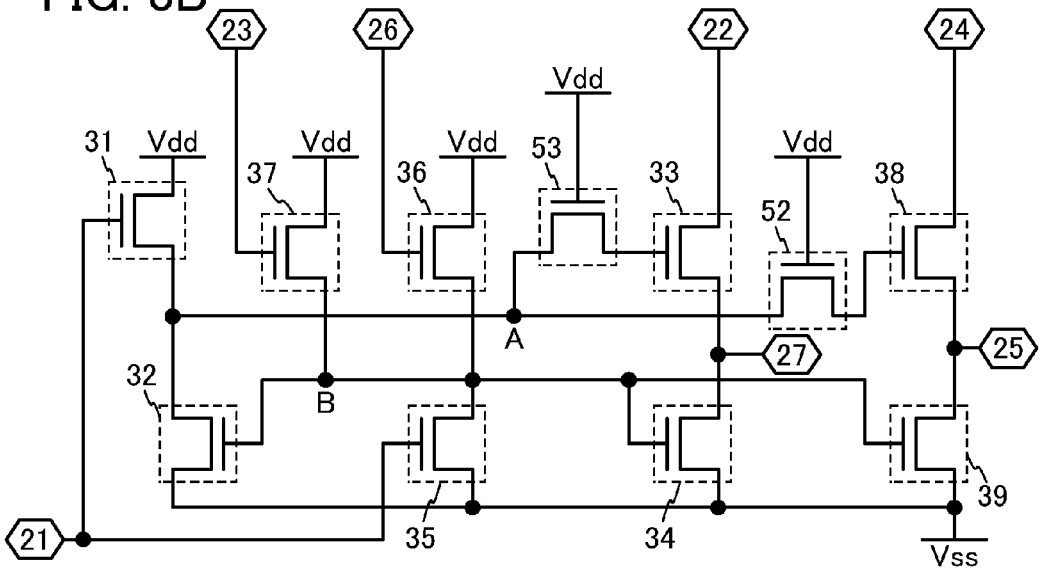

Further alternatively, the pulse output circuit can have a structure in which the transistor 51 is removed from the pulse output circuit illustrated in FIG. 8A and a transistor 53 is added to the pulse output circuit illustrated in FIG. 8A (see FIG. 8B). One of a source and a drain of the transistor 53 is electrically connected to the other of the source and the drain of the transistor 31, the other of the source and the drain of the transistor 32, and one of the source and the drain of the transistor 52; the other of the source and the drain of the transistor 53 is electrically connected to the gate of the transistor 33; and a gate of the transistor 53 is electrically connected to the high power supply potential line. As described above, with the transistor 53, a load at the time of the bootstrapping in the pulse output circuit can be reduced. Further, an effect of a fraud pulse generated in the pulse output circuit on the switching of the transistors 33 and 38 can be decreased.

Further, in the above-described liquid crystal display device, the three kinds of light sources, that is, the light source that emits red (R) light, the light source that emits green (G) light, and the light source that emits blue (B) light are aligned linearly and horizontally as the backlight unit (see FIG. 5); however, the structure of the backlight unit is not limited to this. For example, the three kinds of light sources may be arranged triangularly, or linearly and longitudinally; or a backlight unit having only the light source that emits red (R) light, a backlight unit having only the light source that emits green (G) light a backlight unit having only the light source that emits blue (B) light may be provided separately. Moreover, the above-described liquid crystal display device is provided with a direct-lit backlight as the backlight (see FIG. 5); alternatively, an edge-lit backlight can be used as the backlight.

In the above-described liquid crystal display device, an image is formed in the pixel portion in such a manner that the light sources included in the backlight unit group are turned on in order of the light source that emits red (R) light→the light source that emits green (G) light→the light source that emits blue (B) light or in order of the light source that emits red (R) light and the light source that emits green (G) light→the light source that emits green (G) light and the light source that emits blue (B) light→the light source that emits blue (B) light and the light source that emits the red (R) light (see FIG. 6); however, the order of turning on the light sources included in the backlight unit group for forming an image is not limited to a particular order. In other words, the order of turning on the above-described light sources can be changed as appropriate. In addition, it is possible to control blue (B) light with low luminosity factor so as to be delivered for a longer period than the light of the other colors.

Figure 9:
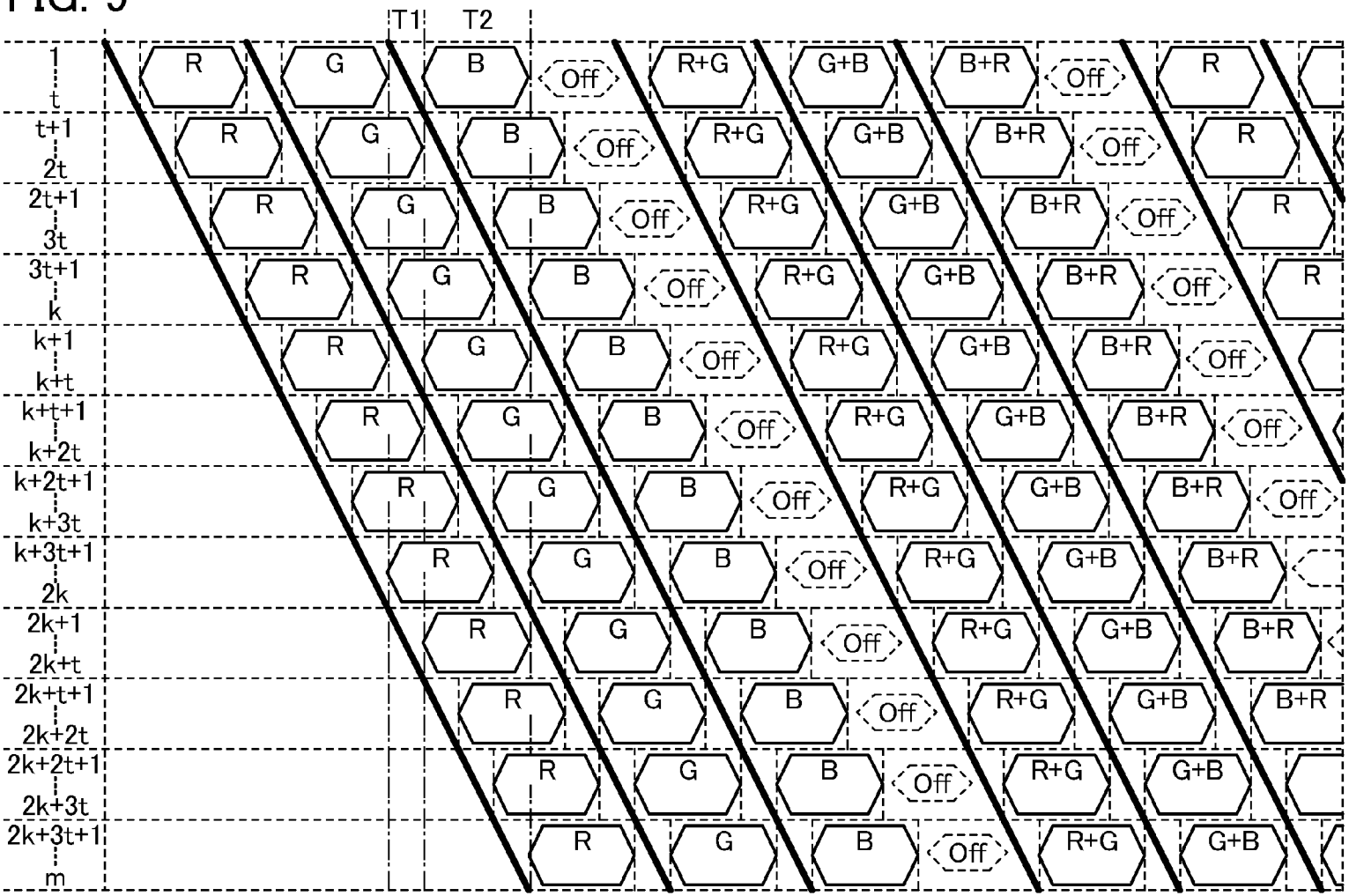
FIG. 9 illustrates an operation example of a liquid crystal display device.

The above-described liquid crystal display device successively performs the scanning of the image signal and the turning on the light sources in a particular backlight unit group (see FIG. 6); however, the operation of the liquid crystal display device is not limited to that of the liquid crystal display device having this structure. For example, before and after a period in which an image is formed in the pixel portion, it is possible to provide a period in which the scanning of the image signal and the turning on the light sources in a particular backlight unit group are not performed (see FIG. 9). Thus, color break generated in the liquid crystal display device can be suppressed, and the image quality of the liquid crystal display device can be improved. Note that the structure in which neither the scanning of the image signal nor the turning on the light sources in a particular backlight unit group are performed is illustrated in FIG. 9; however, the scanning of the image signal for not transmitting light with respect to each pixel can also be performed.

Figure 10:
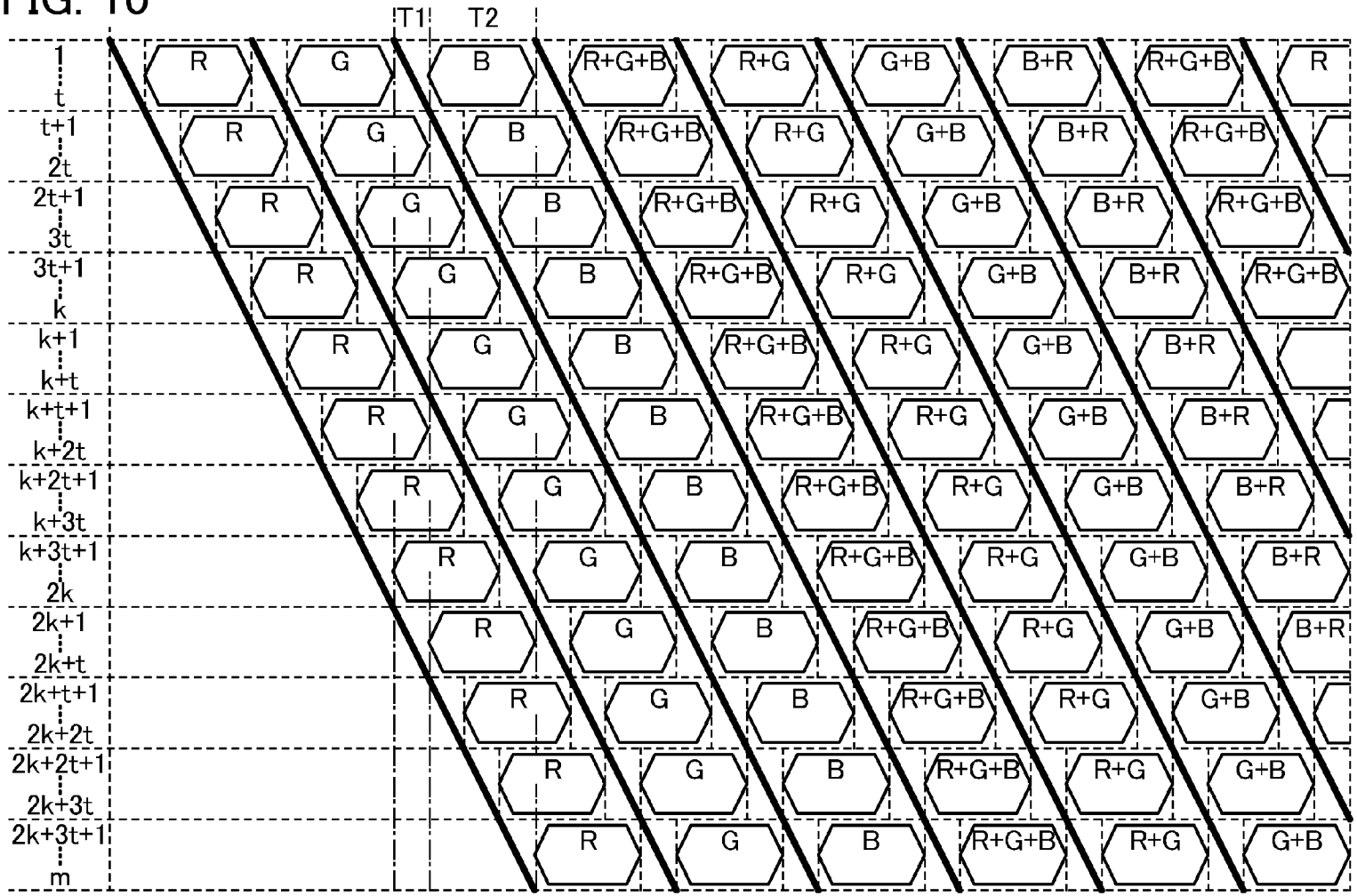
FIG. 10 illustrates an operation example of a liquid crystal display device.

In the above-described liquid crystal display device, an image is formed in each particular region of the pixel portion with using light formed by the tuning on of one or two light sources of three light sources included in the backlight unit (see FIG. 6); however, an image can also be formed in the pixel portion using light formed by turning on all three light sources included in the backlight unit (see FIG. 10). In this case, it is possible to further improve display luminance of the liquid crystal display device and to further subdivide display color tones of the liquid crystal display device. Note that in the operation example illustrated in FIG. 10, an image is formed by the operation from the scanning of the image signal for controlling transmission of red (R) light to the turning on the light source that emits red (R) light, the light source that emits green (G) light, and the light source that emits blue (B) light in the backlight unit group at the same time; and an image following the image is formed by the operation from the scanning of the image signal for controlling transmission of mixed color light formed by a mixture of red (R) light and green (G) light to the turning on the light source that emits red (R) light, the light source that emits green (G) light, and the light source that emits blue (B) light in the backlight unit group at the same time.

In the above-described liquid crystal display device of this embodiment, the three kinds of light sources, that is, the light source that emits red (R) light, the light source that emits green (G) light, and the light source that emits blue (B) light are used in combination for the backlight; however, the liquid crystal display device according to one embodiment of the present invention is not limited to having this structure. In other words, in the liquid crystal display device according to one embodiment of the present invention, light sources that emit lights of different colors can be provided in combination to form a backlight. For example, four kinds of light sources, that is, the light source that emits red (R) light, the light source that emits green (G) light, the light source that emits blue (B) light, and a light source that emits white (W) light or four kinds of light sources, that is, light source that emits red (R) light, the light source that emits green (G) light, the light source that emits blue (B) light, and a light source that emits yellow (Y) light can be used in combination; or three kinds of light sources, that is, a light source that emits cyan (C) light, a light source that emits magenta (M) light, and the light source that emits yellow (Y) light can be used in combination. Note that in the case where a light source that emits white (W) light is included in the backlight unit, the light source has high luminous efficiency; therefore, power consumption of the backlight unit can be reduced. In the case where a backlight unit includes two kinds of light sources that emit complementary color lights (e.g., the case where the backlight unit includes two kinds of light sources, that is, the light source that emits blue (B) light, and the light source that emits yellow (Y) light), the lights emitted from the light sources are mixed, whereby white (W) light can be formed. Moreover, it is possible to use a combination of six kinds of light sources, that is, a light source that emits pale red (R) light, a light source that emits pale green (G) light, a light source that emits pale blue (B), a light source that emits dark red (R) light, a light source that emits dark green (G) light, and a light source that emits dark blue (B) light; or a combination of six kinds of light sources, that is, the light source that emits red (R) light, the light source that emits green (G) light, the light source that emits blue (B) light, the light source that emits cyan (C) light, the light source that emits magenta (M) light, and the light source that emits yellow (Y) light. In such a manner, with a combination of a wider variety of light sources, the color gamut of the liquid crystal display device can be enlarged, and the image quality can be improved.

Note that a plurality of structures described as the modification example can also be applied to the liquid crystal display device described with reference to FIGS. 1A and 1B, FIGS. 2A to 2C, FIGS. 3A to 3D, FIGS. 4A and 4B, FIG. 5, and FIG. 6.

<Specific Example>

A specific structure of the above-described liquid crystal display device will be described below.

<Specific Example of Transistor>

First, a specific example of a transistor used for the pixel portion or the various circuits of the liquid crystal display device described above will be described with reference to FIGS. 11A to 11D. Note that in the liquid crystal display device, the transistors provided in the pixel portion and the various circuits may have either the same structure or different structures.

Figure 11A:
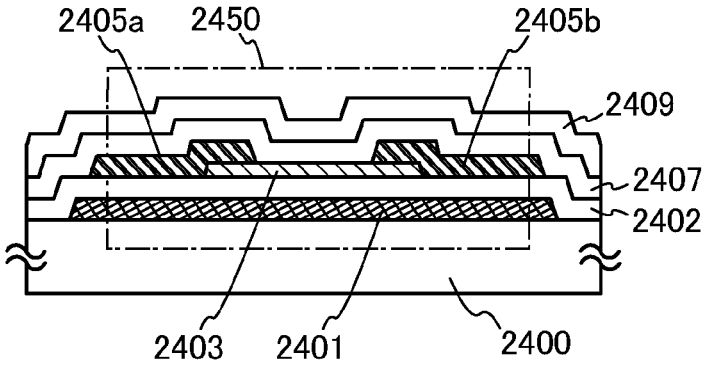
FIGS. 11A to 11D each illustrate a specific example of a transistor.

A transistor 2450 in FIG. 11A includes a gate layer 2401 over a substrate 2400, a gate insulating layer 2402 over the gate layer 2401, a semiconductor layer 2403 over the gate insulating layer 2402, and a source layer 2405*a* and a drain layer 2405*b* over the gate insulating layer 2402 and the semiconductor layer 2403. An insulating layer 2407 is formed over the semiconductor layer 2403, the source layer 2405*a*, and the drain layer 2405*b*. A protective insulating layer 2409 may be formed over the insulating layer 2407. The transistor 2450 is one of bottom-gate transistors.

Figure 11B:
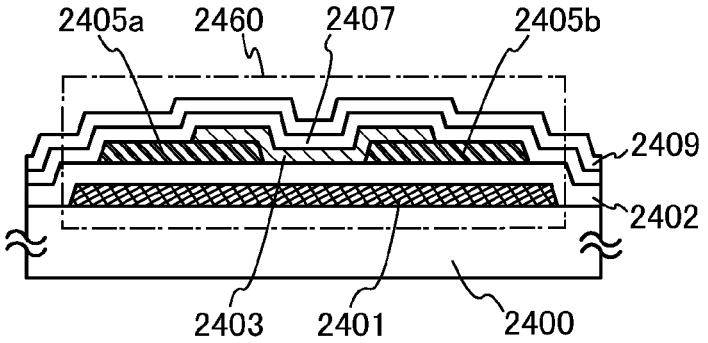

A transistor 2460 illustrated in FIG. 11B includes the gate layer 2401 over the substrate 2400, the gate insulating layer 2402 over the gate layer 2401, the source layer 2405*a* and the drain layer 2405*b* over the gate insulating layer 2402, and the semiconductor layer 2403 over the gate insulating layer 2402, the source layer 2405*a*, and the drain layer 2405*b*. The insulating layer 2407 is formed over the semiconductor layer 2403, the source layer 2405*a*, and the drain layer 2405*b*. The protective insulating layer 2409 may be formed over the insulating layer 2407. The transistor 2460 is one of bottom-gate transistors.

Figure 11C:
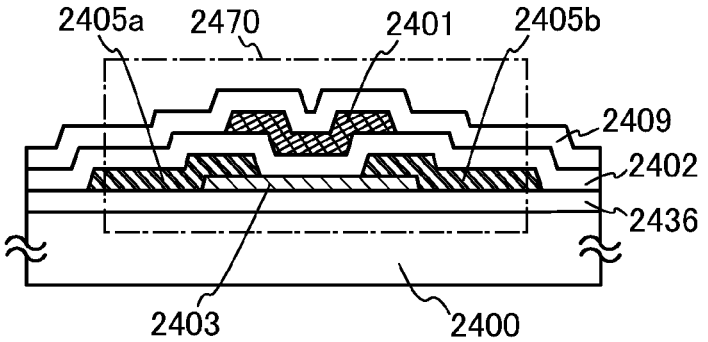

A transistor 2470 illustrated in FIG. 11C includes a base layer 2436 over the substrate 2400; the semiconductor layer 2403 over the base layer 2436; the source layer 2405*a* and the drain layer 2405*b* over the semiconductor layer 2403 and the base layer 2436; the gate insulating layer 2402 over the semiconductor layer 2403, the source layer 2405*a*, and the drain layer 2405*b*; and the gate layer 2401 over the gate insulating layer 2402. The protective insulating layer 2409 may be formed over the gate layer 2401. The transistor 2470 is one of top-gate transistors.

Figure 11D:
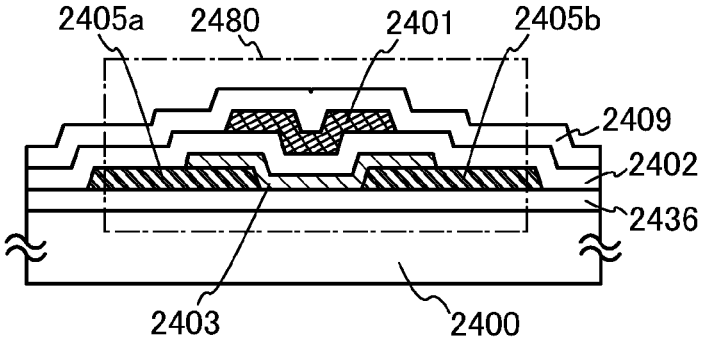

A transistor 2480 illustrated in FIG. 11D includes the base layer 2436 over the substrate 2400; the source layer 2405*a* and the drain layer 2405*b* over the base layer 2436; the semiconductor layer 2403 over the base layer 2436, the source layer 2405*a*, and the drain layer 2405*b*; the gate insulating layer 2402 over the semiconductor layer 2403, the source layer 2405*a*, and the drain layer 2405*b*; and the gate layer 2401 over the gate insulating layer 2402. The protective insulating layer 2409 may be formed over the gate layer 2401. The transistor 2480 is one of top-gate transistors.

Note that examples of the substrate 2400 include a semiconductor substrate (e.g., a single crystal substrate or a silicon substrate), an SOI substrate, a glass substrate, a quartz substrate, a conductive substrate whose top surface is provided with an insulating layer, flexible substrates such as a plastic substrate, a bonding film, paper containing a fibrous material, and a base film. As an example of a glass substrate, a barium borosilicate glass substrate, an aluminoborosilicate glass substrate, soda lime glass substrate, and the like can be given. For a flexible substrate, a flexible synthetic resin such as plastics typified by poly(ethylene terephthalate) (PET), poly(ethylene naphthalate) (PEN), and poly(ether sulfone) (PES), or an acrylic resin can be used, for example.

For the gate layer 2401, an element selected from aluminum (Al), copper (Cu), titanium (Ti), tantalum (Ta), tungsten (W), molybdenum (Mo), chromium (Cr), neodymium (Nd), and scandium (Sc); an alloy containing any of these elements; or a nitride containing any of these elements can be used. A layered structure of these materials can also be used.

For the gate insulating layer 2402, an insulator such as silicon oxide, silicon nitride, silicon oxynitride, silicon nitride oxide, aluminum oxide, tantalum oxide, or gallium oxide can be used. A layered structure of these materials can also be used. Note that silicon oxynitride refers to a substance which contains more oxygen than nitrogen and contains oxygen, nitrogen, silicon, and hydrogen at given concentrations ranging from 55 to 65 atomic %, 1 to 20 atomic %, 25 to 35 atomic %, and 0.1 to 10 atomic %, respectively, where the total percentage of atoms is 100 atomic %. Further, the silicon nitride oxide film refers to a film which contains more nitrogen than oxygen and contains oxygen, nitrogen, silicon, and hydrogen at given concentrations ranging from 15 to 30 atomic %, 20 to 35 atomic %, 25 to 35 atomic %, and 15 to 25 atomic %, respectively, where the total percentage of atoms is 100 atomic %.

The semiconductor layer 2403 can be formed using any of the following semiconductor materials, for example: a material containing an element belonging to Group 14 of the periodic table, such as silicon (Si) or germanium (Ge), as its main component; a compound such as silicon germanium (SiGe) or gallium arsenide (GaAs); an oxide such as zinc oxide (ZnO) or zinc oxide containing indium (In) and gallium (Ga); or an organic compound exhibiting semiconductor characteristics. A layered structure of layers formed using these semiconductor materials can also be used.

In the case where silicon (Si) is used for the semiconductor layer 2403, the crystal state of the semiconductor layer 2403 is not limited. In other words, any of amorphous silicon, microcrystalline silicon, polycrystalline silicon, and single crystal silicon can be used for the semiconductor layer 2403. The Raman spectrum of $cm^{-1}$ microcrystalline silicon is shifted to a lower wavenumber side than 520 $cm^{-1}$ that represents single crystal silicon. In other words, the peak of the Raman spectrum of the microcrystalline silicon exists between 520 $cm^{-1}$ which represents single crystal silicon and 480 $cm^{-1}$ which represents amorphous silicon. The microcrystalline silicon includes at least 1 atomic % or more of hydrogen or halogen to terminate dangling bonds. Moreover, the microcrystalline silicon may contain a rare gas element such as helium, argon, krypton, or neon to further promote lattice distortion, so that stability is increased and a favorable microcrystalline semiconductor can be obtained.

Moreover, in the case where an oxide (an oxide semiconductor) is used for the semiconductor layer 2403, one or more elements selected from In, Ga, Sn, Zn, Al, Mg, Hf, and lanthanoid is/are included. For example, an In—Sn—Ga—Zn—O-based oxide semiconductor which is an oxide of four metal elements; an In—Ga—Zn—O-based oxide semiconductor, an In—Sn—Zn—O-based oxide semiconductor, an In—Al—Zn—O-based oxide semiconductor, a Sn—Ga—Zn—O-based oxide semiconductor, an Al—Ga—Zn—O-based oxide semiconductor, and a Sn—Al—Zn—O-based oxide semiconductor, an In—Hf—Zn—O-based oxide semiconductor, an In—La—Zn—O-based oxide semiconductor, an In—Ce—Zn—O-based oxide semiconductor, an In—Pr—Zn—O-based oxide semiconductor, an In—Nd—Zn—O-based oxide semiconductor, an In—Pm—Zn—O-based oxide semiconductor, an In—Sm—Zn—O-based oxide semiconductor, an In—Eu—Zn—O-based oxide semiconductor, an In—Gd—Zn—O-based oxide semiconductor, an In—Tb—Zn—O-based oxide semiconductor layer, an In—Dy—Zn—O-based oxide semiconductor, an In—Ho—Zn—O-based oxide semiconductor, an In—Er—Zn—O-based oxide semiconductor, an In—Tm—Zn—O-based oxide semiconductor, an In—Yb—Zn—O-based oxide semiconductor, an In—Lu—Zn—O-based oxide semiconductor which are oxides of three metal elements; an In—Ga—O-based oxide, an In—Zn—O-based oxide semiconductor, a Sn—Zn—O-based oxide semiconductor, an Al—Zn—O-based oxide semiconductor, a Zn—Mg—O-based oxide semiconductor, a Sn—Mg—O-based oxide semiconductor, and an In—Mg—O-based oxide semiconductor which are oxides of two metal elements; and an In—O-based oxide semiconductor, a Sn—O-based oxide semiconductor, and a Zn—O-based oxide semiconductor which are oxides of one metal element. Further, $SiO_2$ may be contained in the above oxide semiconductor. Here, for example, the In—Ga—Zn—O-based oxide semiconductor means an oxide containing at least In, Ga, and Zn, and the composition ratio of the elements is not particularly limited. The In—Ga—Zn—O-based oxide semiconductor may contain an element other than In, Ga, and Zn.

As the oxide semiconductor, a thin film represented by the chemical formula, $InMO_3(ZnO)_m$ (m>0) can be used. Here, M represents one or more metal elements selected from Ga, Al, Mn, and Co. For example, M may be Ga, Ga and Al, Ga and Mn, Ga and Co, or the like.

In the case where an In—Zn—O-based material is used as an oxide semiconductor, a target to be used has a composition ratio of In:Zn=50:1 to 1:2 in an atomic ratio ($In_2O_3$: ZnO=25:1 to 1:4 in a molar ratio), preferably In:Zn=20:1 to 1:1 in an atomic ratio ($In_2O_3$: ZnO=10:1 to 1:2 in a molar ratio), further preferably In:Zn=1.5:1 to 15:1 in an atomic ratio ($In_2O_3$: ZnO=3:4 to 15:2 in a molar ratio). For example, in a target used for formation of an In—Zn—O-based oxide semiconductor which has an atomic ratio of In:Zn:O=X: Y: Z, the relation of Z>1.5X+Y is satisfied.

For the source layer 2405*a* and the drain layer 2405*b*, an element selected from aluminum (Al), copper (Cu), titanium (Ti), tantalum (Ta), tungsten (W), molybdenum (Mo), chromium (Cr), neodymium (Nd), and scandium (Sc); an alloy containing any of these elements; or a nitride containing any of these elements can be used. A layered structure of these materials can also be used.

A conductive film to be the source layer 2405*a* and the drain layer 2405*b* (including a wiring layer formed using the same layer as the source and drain layers) may be formed using a conductive metal oxide. As the conductive metal oxide, indium oxide ($In_2O_3$), tin oxide ($SnO_2$), zinc oxide (ZnO), indium oxide-tin oxide ($In_2O_3$—$SnO_2$; abbreviated to ITO), indium oxide-zinc oxide ($In_2O_3$—ZnO), or any of these metal oxide materials in which silicon oxide is contained can be used.

For the insulating layer 2407, an insulator such as silicon oxide, silicon oxynitride, aluminum oxide, aluminum oxynitride, or gallium oxide can be used. A layered structure of these materials can also be used.

For the protective insulating layer 2409, an insulator such as silicon nitride, aluminum nitride, silicon nitride oxide, or aluminum nitride oxide can be used. A layered structure of these materials can also be used.

As the base layer 2436, an insulator such as silicon oxide, silicon nitride, silicon oxynitride, silicon nitride oxide, aluminum oxide, tantalum oxide, or gallium oxide can be used. A layered structure of these materials can also be used.

In the case where an oxide semiconductor is used for the semiconductor layer 2403, an insulating layer in contact with the oxide semiconductor (here, corresponding to the gate insulating layer 2402, the insulating layer 2407, and the base layer 2436) is preferably formed of an insulating material including a Group 13 element and oxygen. Many of oxide semiconductor materials include a Group 13 element, and an insulating material including a Group 13 element works well with an oxide semiconductor. By using an insulating material including a Group 13 element for an insulating layer in contact with the oxide semiconductor, an interface with the oxide semiconductor can keep a favorable state.

An insulating material including a Group 13 element refers to an insulating material including one or more Group 13 elements. As the insulating material including a Group 13 element, gallium oxide, aluminum oxide, aluminum gallium oxide, and gallium aluminum oxide can be given for example. Here, aluminum gallium oxide refers to a material in which the amount of aluminum is larger than that of gallium in atomic percent, and gallium aluminum oxide refers to a material in which the amount of gallium is larger than or equal to that of aluminum in atomic percent.

For example, in the case of forming an insulating layer in contact with an oxide semiconductor layer containing gallium, a material including gallium oxide may be used for an insulating layer, so that favorable characteristics can be kept at the interface between the oxide semiconductor layer and the insulating layer. When the oxide semiconductor layer and the insulating layer containing gallium oxide are provided in contact with each other, hydrogen pileup at the interface between the oxide semiconductor layer and the insulating layer can be reduced, for example. Note that a similar effect can be obtained in the case where an element in the same group as a constituent element of the oxide semiconductor is used in an insulating layer. For example, it is effective to form an insulating layer with the use of a material including aluminum oxide. Note that aluminum oxide has a property of not easily permeating water. Thus, it is preferable to use the material including aluminum oxide in terms of preventing entry of water to the oxide semiconductor layer.

In the case where an oxide semiconductor is used for the semiconductor layer 2403, the insulating material of the insulating layer in contact with the oxide semiconductor preferably includes oxygen in a proportion higher than that in the stoichiometric composition, by heat treatment under an oxygen atmosphere, oxygen doping, or the like. "Oxygen doping" refers to addition of oxygen into a bulk. Note that the term "bulk" is used in order to clarify that oxygen is added not only to a surface of a thin film but also to the inside of the thin film. In addition, "oxygen doping" includes "oxygen plasma doping" in which oxygen which is made to be plasma is added into a bulk. The oxygen doping may be performed using an ion implantation method or an ion doping method.

For example, in the case where the insulating layer is formed using gallium oxide, the composition of gallium oxide can be set to be $Ga_2O_x$ ($x=3+\alpha$, $0<\alpha<1$) by heat treatment under an oxygen atmosphere or oxygen doping.

In the case where the insulating layer is formed using aluminum oxide, the composition of aluminum oxide can be set to be $Al_2O_x$ ($x=3+\alpha$, $0<\alpha<1$) by heat treatment under an oxygen atmosphere or oxygen doping.

In the case where the insulating layer is formed using gallium aluminum oxide (aluminum gallium oxide), the composition of gallium aluminum oxide (aluminum gallium oxide) can be set to be $Ga_xAl_{2-x}O_{3+\alpha}$ ($0<x<2$, $0<\alpha<1$) by heat treatment under an oxygen atmosphere or oxygen doping.

By oxygen doping, an insulating layer which includes a region where the proportion of oxygen is higher than that in the stoichiometric composition can be formed. When the insulating layer including such a region is in contact with the oxide semiconductor layer, oxygen that exists excessively in the insulating layer is supplied to the oxide semiconductor layer, and oxygen deficiency in the oxide semiconductor layer or at an interface between the oxide semiconductor layer and the insulating layer is reduced. Thus, the oxide semiconductor layer can be formed to an i-type or substantially i-type oxide semiconductor.

Note that, in the case where an oxide semiconductor is used for the semiconductor layer 2403, one of insulating layers which are in contact with the semiconductor layer 2403 and are located on the upper side and the lower side may be an insulating layer which includes a region where the proportion of oxygen is higher than that in the stoichiometric composition. However, both the insulating layers are preferably insulating layers which each include a region where the proportion of oxygen is higher than that in the stoichiometric composition. The above-described effect can be enhanced with a structure where the semiconductor layer 2403 is provided between the insulating layers which each include a region where the proportion of oxygen is higher than that in the stoichiometric composition, which are used as the insulating layers in contact with the semiconductor layer 2403 and located on the upper side and the lower side of the semiconductor layer 2403.

In the case where an oxide semiconductor is used for the semiconductor layer 2403, the insulating layers on the upper side and the lower side of the semiconductor layer 2403 may include the same constituent element or different constituent elements. For example, the insulating layers on the upper side and the lower side may be both formed of gallium oxide whose composition is $Ga_2O_x$ ($x=3+\alpha$, $0<\alpha<1$). Alternatively, one of the insulating layers on the upper side and the lower side may be formed of gallium oxide whose composition is $Ga_2O_x$ ($x=3+\alpha$, $0<\alpha<1$) and the other may be formed of aluminum oxide whose composition is $Al_2O_x$ ($x=3+\alpha$, $0<\alpha<1$).

In the case where an oxide semiconductor is used for the semiconductor layer 2403, an insulating layer in contact with the semiconductor layer 2403 may be formed by stacking insulating layers which each include a region where the proportion of oxygen is higher than that in the stoichiometric composition. For example, the insulating layer on the upper side of the semiconductor layer 2403 may be formed as follows: gallium oxide whose composition is $Ga_2O_x$ ($x=3+\alpha$, $0<\alpha<1$) is formed and gallium aluminum oxide (aluminum gallium oxide) whose composition is $Ga_xAl_{2-x}O_{3-\alpha}$ ($0<x<2$, $0<\alpha<1$) may be formed thereover. Note that the insulating layer on the lower side of the semiconductor layer 2403 may be formed by stacking insulating layers which each include a region where the proportion of oxygen is higher than that in the stoichiometric composition. Further, both of the insulating films on the upper side and the lower side of the semiconductor layer 2403 may be formed by stacking insulating layers which each include a region where the proportion of oxygen is higher than that in the stoichiometric composition.

In the case where an oxide semiconductor is used for the semiconductor layer 2403, a transistor might be degraded by light irradiation. Specifically, a negative shift of the threshold voltage of the transistor after a negative-bias temperature stress photodegradation test might be generated. Specifically, the negative-bias temperature stress photodegradation test is performed in such a way that the temperature of a substrate over which a transistor is formed (substrate temperature) is set at fixed temperature, a source and a drain of the transistor are set at the same potential, and a gate is supplied with a potential which is lower than those of the source and the drain for a certain period while the transistor is irradiated with light. Therefore, in the case where an oxide semiconductor is used for the semiconductor layer 2403, it is preferable to provide a light-blocking layer or the like so as not to irradiate the semiconductor layer 2403 with light.

<Specific Example of Layout of Pixel>

Figure 12A:
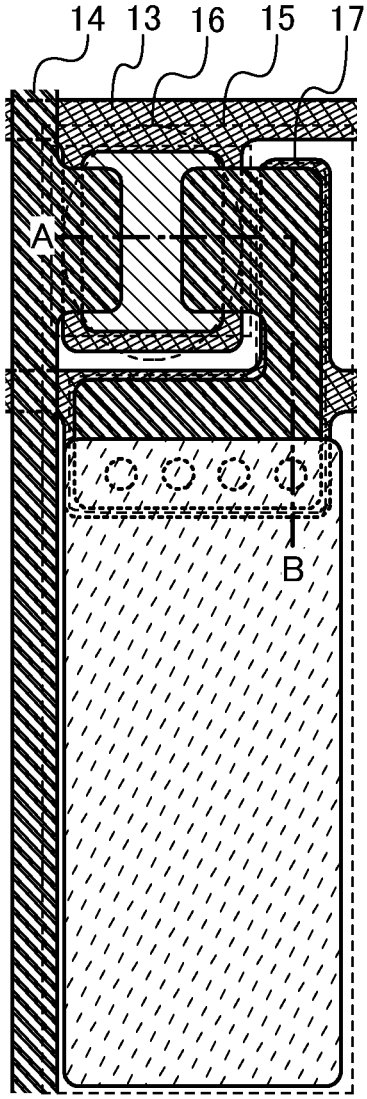
FIGS. 12A and 12B are top views of a specific example of a layout of a pixel.
Figure 12B:
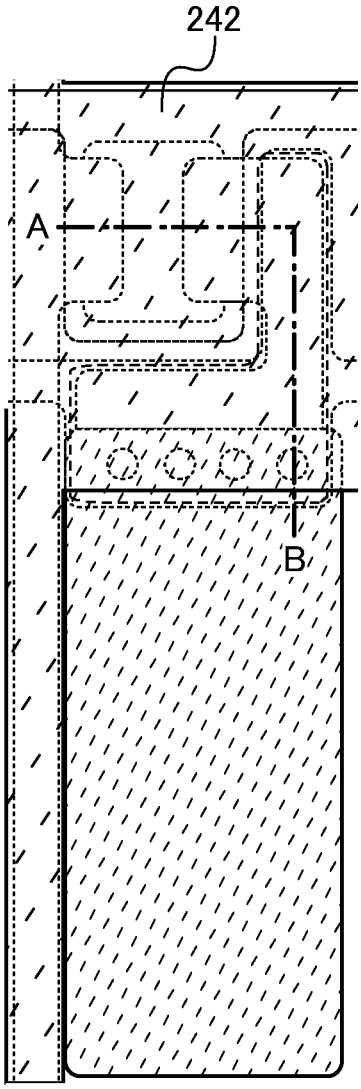
Figure 13:
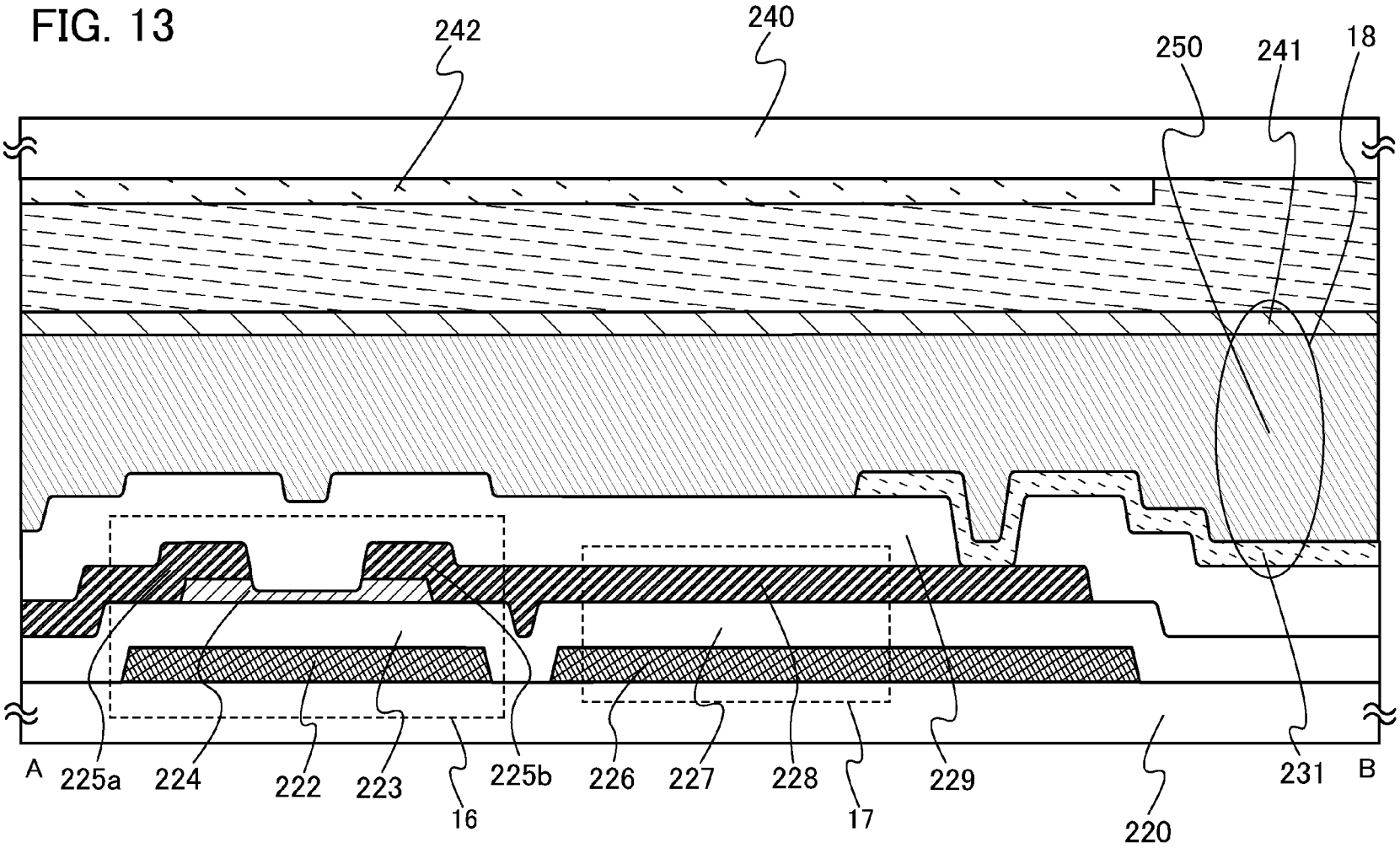
FIG. 13 is a cross-sectional view of a specific example of a layout of a pixel.

Next, specific examples of a layout of pixels in the above-described liquid crystal display device will be described with reference to FIGS. 12A and 12B and FIG. 13. Note that FIG. 12A is a top view of a layout of the pixel illustrated in FIG. 1B. FIG. 12B illustrates a layout including a light-blocking layer 242 provided over the pixel illustrated in FIG. 12A. FIG. 13 is a cross-sectional view taken along line A-B in FIGS. 12A and 12B. Note that structures of a liquid crystal layer, a counter electrode, and the like are omitted in FIGS. 12A and 12B. Hereinafter, a specific structure will be described with reference to FIG. 13.

The transistor 16 includes a conductive layer 222 over a substrate 220, an insulating layer 223 over the conductive layer 222, a semiconductor layer 224 which is over the conductive layer 222 with the insulating layer 223 interposed therebetween, a conductive layer 225*a* over one end of the semiconductor layer 224, and a conductive layer 225*b* over the other end of the semiconductor layer 224. Note that the conductive layer 222 functions as a gate layer. The insulating layer 223 functions as a gate insulating layer. One of the conductive layer 225*a* and the conductive layer 225*b* functions as a source layer, and the other of the conductive layer 225*a* and the conductive layer 225*b* functions as a drain layer.

The capacitor 17 includes a conductive layer 226 over the substrate 220, an insulating layer 227 over the conductive layer 226, and a conductive layer 228 over the conductive layer 226 with the insulating layer 227 interposed therebetween. Note that the conductive layer 226 functions as one of electrodes of the capacitor 17. The insulating layer 227 functions as a dielectric of the capacitor 17. The conductive layer 228 functions as the other of the electrodes of the capacitor 17. The conductive layer 226 is formed using the same material as the conductive layer 222. The insulating layer 227 is formed using the same material as the insulating layer 223. The conductive layer 228 is formed using the same material as the conductive layer 225*a* and the conductive layer 225*b*. The conductive layer 226 is electrically connected to the conductive layer 225*b*.

Note that an insulating layer 229 is provided over the transistor 16 and the capacitor 17.

The liquid crystal element 18 includes a transparent conductive layer 231 over the insulating layer 229, a transparent conductive layer 241 on a counter substrate 240, and a liquid crystal layer 250 interposed between the transparent conductive layer 231 and the transparent conductive layer 241. Note that the transparent conductive layer 231 functions as a pixel electrode of the liquid crystal element 18. The transparent conductive layer 241 functions as a counter electrode of the liquid crystal element 18. The transparent conductive layer 231 is electrically connected to the conductive layer 225*b* and the conductive layer 228.

Note that an alignment film may be provided as appropriate between the transparent conductive layer 231 and the liquid crystal layer 250 or between the transparent conductive layer 241 and the liquid crystal layer 250. The alignment film can be formed using an organic resin such as polyimide or poly (vinyl alcohol). Alignment treatment such as rubbing is performed on the surface in order to align liquid crystal molecules in a certain direction. Rubbing can be performed by rolling a roller wrapped with a cloth of nylon or the like while being in contact with the alignment film and the surface of the alignment film is rubbed in a certain direction. Note that it is also possible to form the alignment film that has alignment characteristics with the use of an inorganic material such as silicon oxide by an evaporation method, without alignment treatment.

Injection of liquid crystal for forming the liquid crystal layer 250 may be performed by a dispenser method (dropping method) or a dipping method (pumping method).

Note that the light-blocking layer 242 which can block light is formed on the counter substrate 240 so that disclination caused by disorder of alignment of the liquid crystals between pixels is prevented from being observed or diffusion light is prevented from entering a plurality of pixels which is adjacent to each other in parallel. The light-blocking layer 242 can be formed using an organic resin containing a black pigment such as a carbon black or low-valent titanium oxide whose oxidation number is smaller than that of titanium dioxide. Alternatively, a film formed using chromium can be used for the light-blocking layer 242.

In particular, in the case where an oxide semiconductor is used for the semiconductor layer 224 of the transistor 16, the structure illustrated in FIG. 13 is preferable in the following point. As described above, a transistor in which an oxide semiconductor is used for a semiconductor layer is degraded by light irradiation in some cases. In contrast, light can be blocked from reaching the semiconductor layer 224 of the transistor 16 illustrated in FIG. 13 because of at least the conductive layers 222, 225*a*, and 225*b* and the light-blocking layer 242. Therefore, reliability of the transistor 16 can be improved.

The transparent conductive layer 231 and the transparent conductive layer 241 can be formed using a light-transmitting conductive material such as indium tin oxide including silicon oxide (ITSO), indium tin oxide (ITO), zinc oxide (ZnO), indium zinc oxide (IZO), or gallium-doped zinc oxide (GZO), for example.

Note that FIG. 13 illustrates a liquid crystal element with a structure where the liquid crystal layer 250 is provided between the transparent conductive layer 231 and the transparent conductive layer 241; however, the structure of the liquid crystal display device according to one embodiment of the present invention is not limited to this structure. A pair of electrodes may be formed over one substrate as in an IPS liquid crystal element or a liquid crystal element using a liquid crystal exhibiting a blue phase. In particular, since a liquid crystal element using a liquid crystal exhibiting a blue phase has a high response speed, the liquid crystal element is suitable for a liquid crystal element included in a field-sequential liquid crystal display device which requires high speed operation.

<Specific Example of Liquid Crystal Display Device>

Figure 14A:
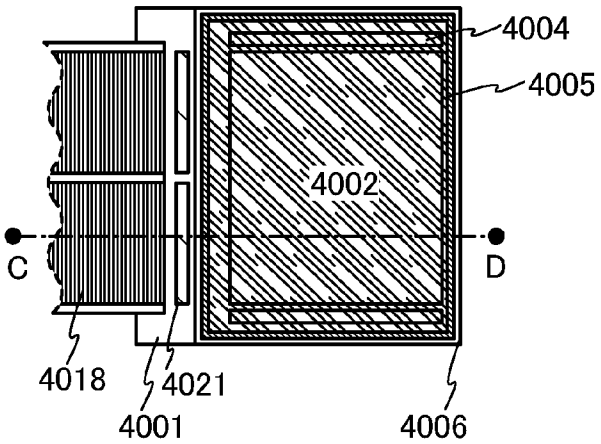
FIG. 14A is a top view of a specific example of a liquid crystal display device.
Figure 14B:
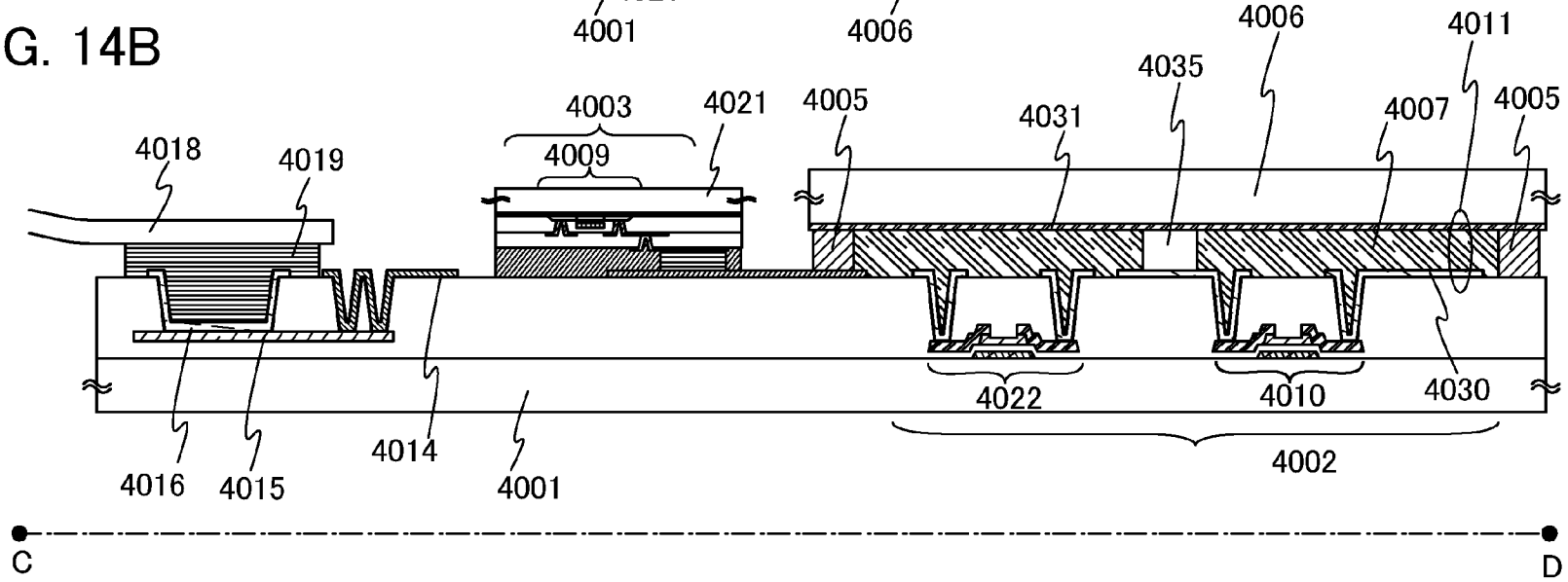
FIG. 14B is a cross-sectional view of the specific example of the liquid crystal display device.

Next, a specific example of a panel of a liquid crystal display device will be described with reference to FIGS. 14A and 14B. FIG. 14A is a top view of a panel where a substrate 4001 and a counter substrate 4006 are bonded to each other with a sealant 4005. FIG. 14B corresponds to a cross-sectional view taken along broken line C-D in FIG. 14A.

The sealant 4005 is provided so as to surround a pixel portion 4002 and a scan line driver circuit 4004 provided over the substrate 4001. In addition, the counter substrate 4006 is provided over the pixel portion 4002 and the scan line driver circuit 4004. Thus, the pixel portion 4002 and the scan line driver circuit 4004 are sealed together with liquid crystals 4007 by the substrate 4001, the sealant 4005, and the counter substrate 4006.

A substrate 4021 provided with a signal line driver circuit 4003 is mounted in a region which is different from a region surrounded by the sealant 4005 over the substrate 4001. FIG. 14B illustrates a transistor 4009 included in the signal line driver circuit 4003.

A plurality of transistors is included in the pixel portion 4002 and the scan line driver circuit 4004 which are provided over the substrate 4001. FIG. 14B illustrates transistors 4010 and 4022 which are included in the pixel portion 4002.

A pixel electrode 4030 included in a liquid crystal element 4011 is electrically connected to the transistor 4010. A counter electrode 4031 of the liquid crystal element 4011 is formed on the counter substrate 4006. A portion where the pixel electrode 4030, the counter electrode 4031, and the liquid crystal 4007 overlap with each other corresponds to the liquid crystal element 4011.

A spacer 4035 is provided in order to control a distance (cell gap) between the pixel electrode 4030 and the counter electrode 4031. Note that although FIG. 14B illustrates the case where the spacer 4035 is obtained by patterning of an insulating film, a spherical spacer may be used.

A variety of signals and potentials are supplied to the signal line driver circuit 4003, the scan line driver circuit 4004, and the pixel portion 4002 from a connection terminal 4016 through lead wirings 4014 and 4015. The connection terminal 4016 is electrically connected to a terminal of an FPC 4018 through an anisotropic conductive film 4019.

Note that as the substrate 4001, the counter substrate 4006, and the substrate 4021, glass, ceramics, or plastics can be used. Plastics include a fiberglass-reinforced plastic (FRP) plate, a poly(vinyl fluoride) (PVF) film, a polyester film, an acrylic resin film, and the like.

Note that a light-transmitting material such as a glass plate, plastics, a polyester film, or an acrylic resin film is used for a substrate which is positioned in a direction in which light is extracted through the liquid crystal element 4011.

Figure 15:
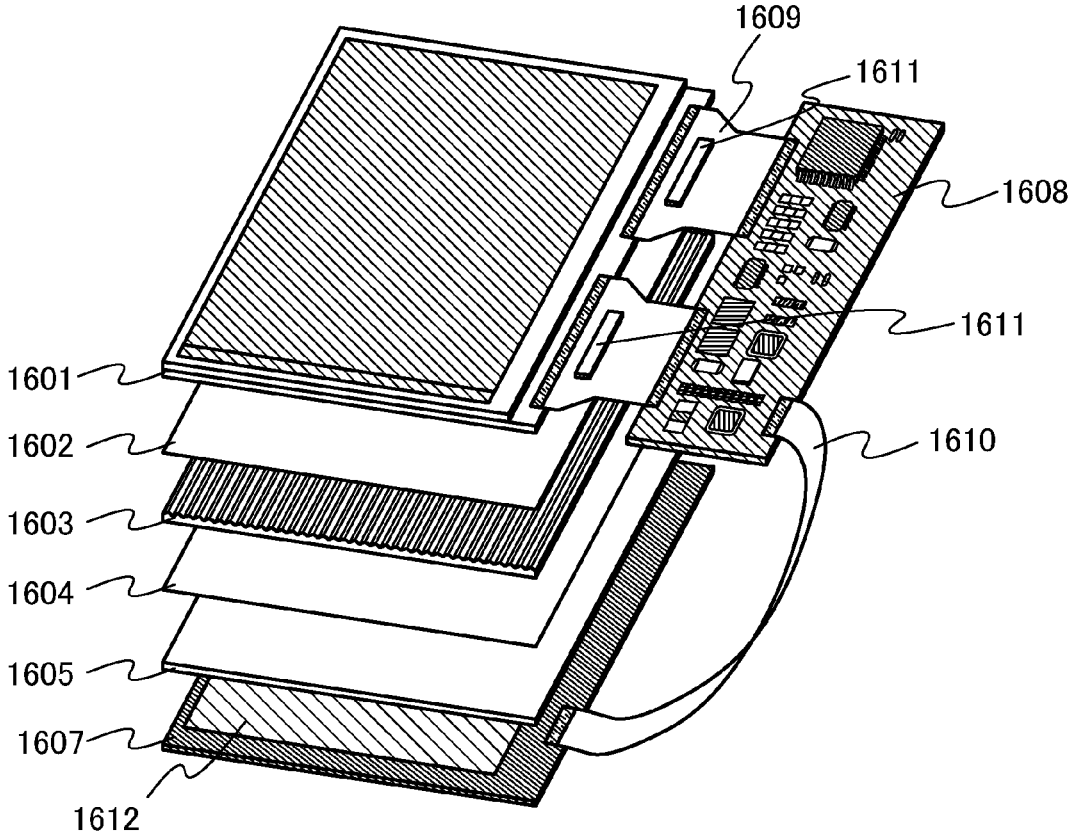
FIG. 15 is a perspective view of a specific example of a liquid crystal display device.

FIG. 15 is an example of a perspective view of the structure of the liquid crystal display device according to one embodiment of the present invention. The liquid crystal display device illustrated in FIG. 15 includes a panel 1601 including a pixel portion, a first diffusion plate 1602, a prism sheet 1603, a second diffusion plate 1604, a light guide plate 1605, a backlight panel 1607, a circuit board 1608, and substrates 1611 provided with signal line driver circuits.

The panel 1601, the first diffusion plate 1602, the prism sheet 1603, the second diffusion plate 1604, the light guide plate 1605, and the backlight panel 1607 are sequentially stacked. The backlight panel 1607 includes a backlight 1612 including a plurality of backlight units. Light from the backlight 1612 that is diffused in the light guide plate 1605 is delivered to the panel 1601 through the first diffusion plate 1602, the prism sheet 1603, and the second diffusion plate 1604.

Although the first diffusion plate 1602 and the second diffusion plate 1604 are used in this embodiment, the number of diffusion plates is not limited to two. The number of diffusion plates may be one, or may be three or more. It is acceptable as long as the diffusion plate is provided between the light guide plate 1605 and the panel 1601. Thus, the diffusion plate may be provided only on a side closer to the panel 1601 than the prism sheet 1603, or may be provided only on a side closer to the light guide plate 1605 than the prism sheet 1603.

Further, the shape of the cross section of the prism sheet 1603 is not limited to a sawtooth shape illustrated in FIG. 15, but may be a shape with which light from the light guide plate 1605 can be concentrated on the panel 1601 side.

The circuit board 1608 includes a circuit for generating various kinds of signals to be input to the panel 1601, a circuit for processing the signals, and the like. In addition, in FIG. 15, the circuit board 1608 and the panel 1601 are connected to each other via COF tapes 1609. Further, the substrates 1611 provided with the signal line driver circuits are connected to the COF tapes 1609 by a chip on film (COF) method.

FIG. 15 illustrates an example in which the circuit board 1608 is provided with a control circuit which controls driving of the backlight 1612 and the control circuit and the backlight panel 1607 are connected to each other through an FPC 1610. Note that the control circuit may be formed over the panel 1601. In that case, the panel 1601 and the backlight panel 1607 are connected to each other through an FPC or the like.

<Specific Example of Substrate for Liquid Crystal Display Device>

Next, a specific example of a substrate used in the above-described liquid crystal display device will be described with reference to FIGS. 16A, 16B, 16C1, 16C2, 16D1, 16D2, 16E1, and 16E2, and FIGS. 17A to 17C.

First, over a formation substrate 6200, a layer to be separated 6116 including a necessary element as an element substrate, such as a transistor, an interlayer insulating film, a wiring, or a pixel electrode is formed so that a separation layer 6201 is interposed between the formation substrate 6200 and the layer to be separated 6116.

As the formation substrate 6200, a quartz substrate, a sapphire substrate, a ceramic substrate, a glass substrate, a metal substrate, or the like can be used. Note that a substrate having a thickness without clearly exhibiting flexibility is used for such a substrate, whereby an element such as a transistor can be formed with high accuracy. The thickness with which flexibility is not clearly expressed means approximately elastic modulus of a glass substrate used when a liquid crystal display is normally formed, or higher than the elastic module.

The separation layer 6201 is formed by a sputtering method, a plasma-enhanced CVD method, a coating method, a printing method, or the like to be a single layer or a stacked layer using an element such as tungsten (W), molybdenum (Mo), titanium (Ti), tantalum (Ta), niobium (Nb), nickel (Ni), cobalt (Co), zirconium (Zr), zinc (Zn), ruthenium (Ru), rhodium (Rh), palladium (Pd), osmium (Os), iridium (Ir), or silicon (Si); an alloy material containing any of the elements as its main component; or a compound material containing any of the elements as its main component.

In the case where the separation layer 6201 has a single-layer structure, a tungsten layer, a molybdenum layer, or a layer containing a mixture of tungsten and molybdenum is preferably formed. Alternatively, the separation layer 6201 can be formed using a layer containing an oxide of tungsten, a layer containing an oxynitride of tungsten, a layer containing an oxide of molybdenum, a layer containing an oxynitride of molybdenum, or a layer containing an oxide or an oxynitride of a mixture of tungsten and molybdenum. Note that the mixture of tungsten and molybdenum corresponds to an alloy of tungsten and molybdenum, for example.

In the case where the separation layer 6201 has a layered structure, preferably, a metal layer is formed as a first layer, and a metal oxide layer is formed as a second layer. Typically, a tungsten layer, a molybdenum layer, or a layer containing a mixture of tungsten and molybdenum may be formed as a first layer, and a layer containing oxide, nitride, oxynitride, or nitride oxide of tungsten, molybdenum, or a mixture of tungsten and molybdenum may be formed as a second layer. For the formation of a metal oxide layer as the second layer, the following method may be applied: an oxide layer (e.g., a layer which can be used as an insulating layer of silicon oxide or the like) is formed over a metal layer as the first layer, whereby an oxide of the metal is formed on a surface of the metal layer.

Figure 16A:
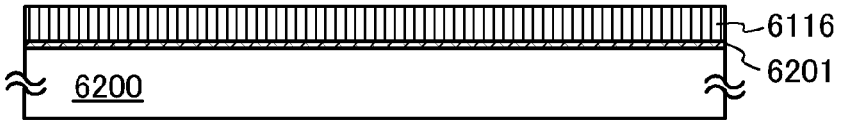

The layer to be separated 6116 is formed over the separation layer 6201 (see FIG. 16A). The layer to be separated 6116 includes a necessary element as an element substrate, such as a transistor, an interlayer insulating film, a wiring, or a pixel electrode. These elements can be formed by a photolithography method or the like.

Figure 16B:
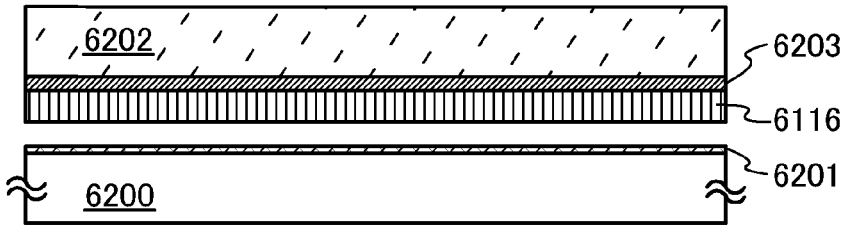
Figure 16B:
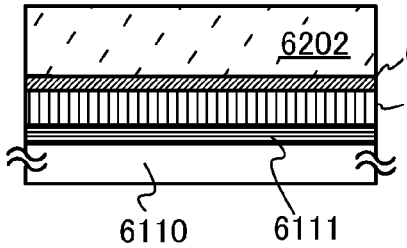
Figure 16B:
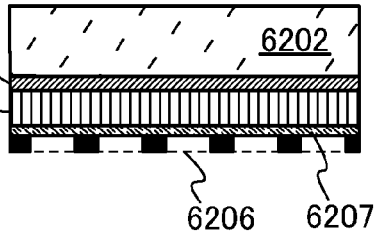
Figure 16B:
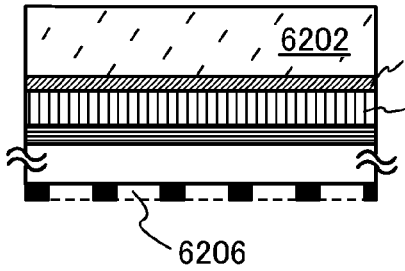
Figure 16B:
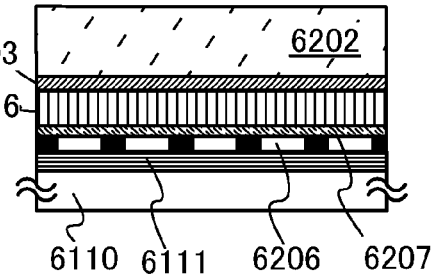
Figure 16B:
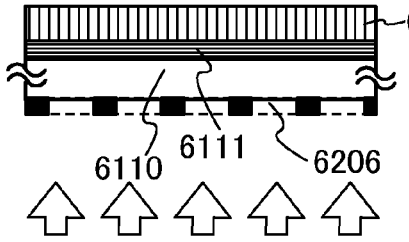
Figure 16B:
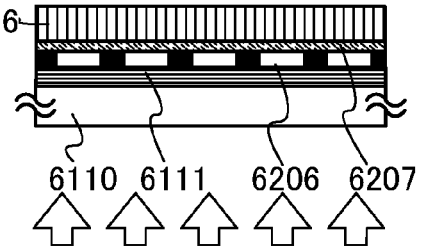

Next, after the layer to be separated 6116 is bonded to a temporary supporting substrate 6202 using an adhesive 6203 for separation, the layer to be separated 6116 is separated from the separation layer 6201 of the formation substrate 6200 and transferred to the temporary supporting substrate 6202 (see FIG. 16B). By this process, the layer to be separated 6116 is placed on the temporary supporting substrate side. Note that in this specification, a process in which a layer to be separated is transferred to a temporary supporting substrate from a formation substrate is referred to as a transfer process.

As the temporary supporting substrate 6202, a glass substrate, a quartz substrate, a sapphire substrate, a ceramic substrate, a metal substrate, or the like can be used. Alternatively, a plastic substrate which can withstand the following process temperature may be used.

As the adhesive 6203 for separation which is used here, an adhesive which is soluble in water or a solvent, an adhesive which is capable of being plasticized upon irradiation of UV light or the like, and the like are used so that the temporary supporting substrate 6202 and the layer to be separated 6116 can be separated when necessary.

Any of various methods can be used as appropriate as the process for transferring the layer to be separated to the temporary supporting substrate 6202. For example, when a film including a metal oxide film is formed as the separation layer 6201 on the side in contact with the layer to be separated 6116, the metal oxide film is embrittled by crystallization, whereby the layer to be separated 6116 can be separated from the formation substrate 6200. When an amorphous silicon film containing hydrogen is formed as the separation layer 6201 between the formation substrate 6200 and the layer to be separated 6116, by removing the amorphous silicon film containing hydrogen by laser light irradiation or etching, the layer to be separated 6116 can be separated from the formation substrate 6200. In addition, in the case where a film containing nitrogen, oxygen, hydrogen, or the like (e.g., an amorphous silicon film containing hydrogen, a film of an alloy containing hydrogen, or a film of an alloy containing oxygen) is used as the separation layer 6201, the separation layer 6201 is irradiated with laser light, so that nitrogen, oxygen, or hydrogen contained in the separation layer 6201 can be released as a gas to promote separation between the layer to be separated 6116 and the formation substrate 6200. Alternatively, separation of the layer to be separated 6116 from the formation substrate 6200 may be carried out after a liquid is made to penetrate an interface between the separation layer 6201 and the layer to be separated 6116. As another separation method, when the separation layer 6201 is formed using tungsten, the separation may be performed while the separation layer 6201 is etched with the use of a mixed solution of ammonia water and a hydrogen peroxide solution.

When a plurality of the above-described separation methods is combined, the separation process can be conducted easily. This corresponds to the following process or the like: the separation is performed with physical force (by a machine or the like) after performing laser light irradiation; etching on the separation layer 6201 with a gas, a solution, or the like; or partial mechanical removal with a sharp knife, scalpel, or the like so as to make a condition where the separation layer 6201 and the layer to be separated 6116 can be easily separated from each other. In the case where the separation layer 6201 is formed using a layered structure of metal and metal oxide, the layer to be separated 6116 can be easily physically separated from the separation layer 6201 using a groove formed by laser irradiation; a flaw formed by a sharp knife, scalpel, or the like; or the like, as a trigger.

Further alternatively, the separation may be performed while pouring a liquid such as water during the separation.

As another method in which the layer to be separated 6116 is separated from the formation substrate 6200, a method in which the formation substrate 6200 provided with the layer to be separated 6116 is removed by mechanical polishing or the like, a method in which the formation substrate 6200 provided with the layer to be separated 6116 is removed by etching using a solution or a halogen fluoride gas such as $NF_3$, $BrF_3$, or $ClF_3$, or the like may be used. In this case, the separation layer 6201 is not necessarily provided.

Next, the separation layer 6201 which is separated from the formation substrate 6200 and exposed or the surface of the layer to be separated 6116 is bonded to a transfer substrate 6110 with the use of a first adhesive layer 6111 including an adhesive different from the adhesive 6203 for separation (see FIG. 16C1).

As a material of the first adhesive layer 6111, various curable adhesives, e.g., a light curable adhesive such as a UV curable adhesive, a reactive curable adhesive, a thermal curable adhesive, and an anaerobic adhesive can be used.

As the transfer substrate 6110, various substrates with high toughness can be used; for example, an organic resin film, a metal substrate, or the like can be preferably used. The substrate with high toughness is superior in resistance to shock and difficult to break. The organic resin film is lightweight, and the metal substrate is also lightweight when it is thin; therefore, a large reduction in weight can be achieved, as compared to the case where a normal glass substrate is used. With such a substrate, a display device which is lightweight and difficult to break can be formed.

As a material used for forming such a substrate, for example, a polyester resin such as poly(ethylene terephthalate) (PET) or poly(ethylene naphthalate) (PEN), an acrylic resin, a polyacrylonitrile resin, a polyimide resin, poly(methyl methacrylate), a polycarbonate (PC) resin, a polyethersulfone (PES) resin, a polyamide resin, a polycycloolefin resin, polystyrene, a polyamide imide resin, a polyvinylchloride resin, and the like can be given. A substrate formed using any of these organic materials has high toughness; therefore, the substrate is superior even in resistance to shock and difficult to break. Further, these organic materials are lightweight; therefore, a display device whose weight is largely reduced in comparison with the case where a normal glass substrate is used can be formed. In this case, it is preferable that the transfer substrate 6110 further include a metal plate 6206 provided with an opening in a portion overlapped with at least a region of each pixel through which light is transmitted. With this structure, the transfer substrate 6110 which is difficult to break and which has high toughness and high resistance to shock while suppressing a change in dimension can be formed. Further, the thickness of the metal plate 6206 is small, so that the transfer substrate 6110 which has lower weight than a conventional glass substrate can be formed. When such a substrate is used, a lightweight display device which is difficult to break can be formed (see FIG. 16D1).

Figure 17A:
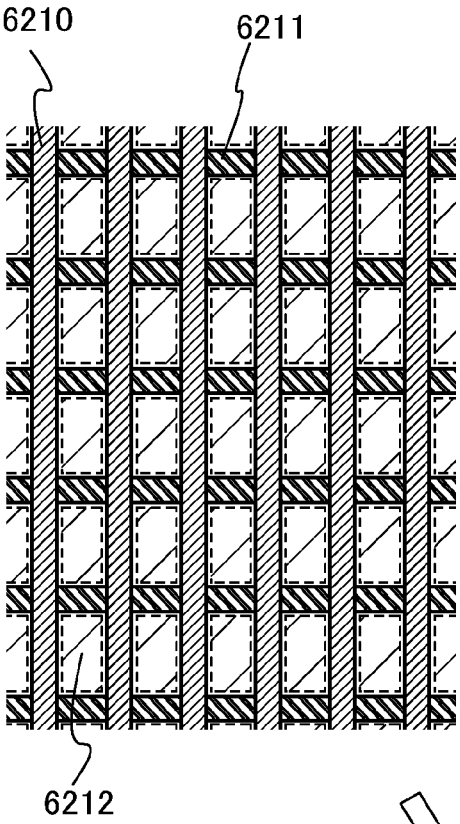
FIG. 17A is a top view of an example of a liquid crystal display device.
Figure 17B:
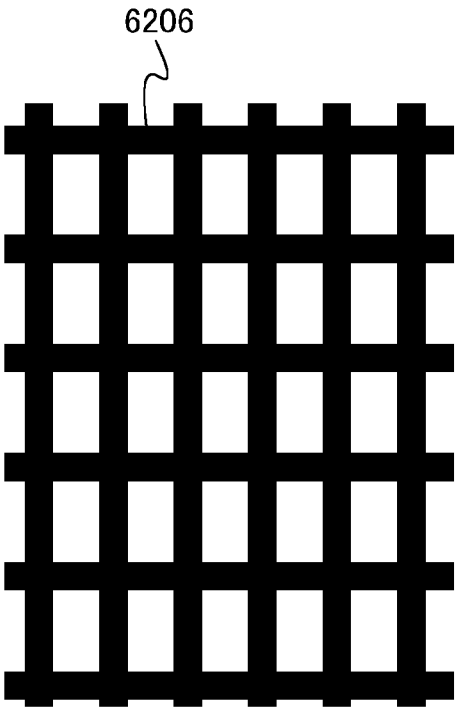
FIG. 17B illustrates an example of a metal plate attached to the liquid crystal display device.
Figure 17C:
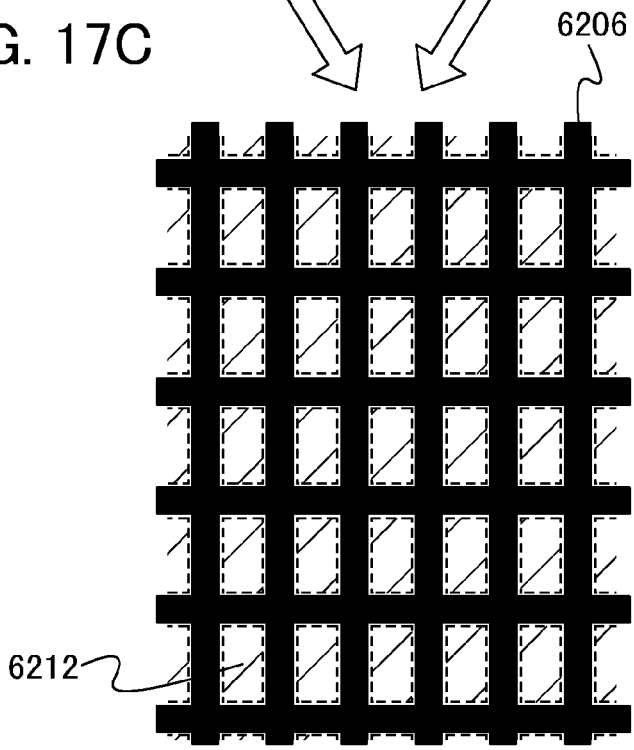
FIG. 17C illustrates an example of the liquid crystal display device to which the metal plate is attached.

FIG. 17A illustrates an example of a top view of a liquid crystal display device. In the case of a liquid crystal display device in which a first wiring layer 6210 intersects with a second wiring layer 6211 and a region surrounded by the first wiring layer 6210 and the second wiring layer 6211 is a light-transmitting region 6212 as illustrated in FIG. 17A, the metal plate 6206 in which a portion overlapped with the first wiring layer 6210 and the second wiring layer 6211 remains and openings in a grid are provided as illustrated in FIG. 17B may be used. FIG. 17C is a view in which the liquid crystal display device illustrated in FIG. 17A is attached to the metal plate 6206 illustrated in FIG. 17B. The metal plate 6206 is attached to the first wiring layer 6210 and the second wiring layer 6211 as illustrated in FIG. 17C, whereby a reduction in accuracy of alignment due to the use of a substrate formed using an organic resin or a change in dimension due to a stretch of a substrate can be suppressed. Note that in the case where a polarization plate (not illustrated) is needed, the polarization plate may be provided between the transfer substrate 6110 and the metal plate 6206 or may be provided outside the metal plate 6206. The polarization plate may be attached to the metal plate 6206 in advance. Note that in terms of reduction in weight, it is preferable to use a thin substrate as the metal plate 6206 as far as the effect of the stability of the dimension is produced.

Then, the temporary supporting substrate 6202 is separated from the layer to be separated 6116. The adhesive 6203 for separation is formed using a material which can separate the temporary supporting substrate 6202 and the layer to be separated 6116 when necessary; therefore, the temporary supporting substrate 6202 may be separated by a method suited to the material. Note that a backlight is turned on, so that the transfer substrate 6110 is irradiated with light from the direction shown by arrows in the drawing (see FIG. 16E1).

As described above, the layer to be separated 6116 provided with elements from a transistor to a pixel electrode can be formed over the transfer substrate 6110, and an element substrate which is lightweight and has high resistance to shock can be formed.

The display device having the above-described configuration is one embodiment of the present invention; the present invention also includes a display device that has a structure which is different from the structure of the display device. After the transfer process (see FIG. 16B) and before the transfer substrate 6110 is attached to the temporary supporting substrate 6202, the metal plate 6206 may be attached to the exposed separation layer 6201 or the surface of the layer to be separated 6116 (see FIG. 16C2). In this case, a barrier layer 6207 may be provided between the metal plate 6206 and the layer to be separated 6116 so that a contaminant from the metal plate 6206 is prevented from adversely affecting characteristics of the transistor in the layer to be separated 6116. In the case where the barrier layer 6207 is provided, after the barrier layer 6207 is provided on the exposed separation layer 6201 or the surface of the layer to be separated 6116, the metal plate 6206 may be attached to the barrier layer 6207. The barrier layer 6207 may be formed using an inorganic material, an organic material, or the like and typically silicon nitride and the like can be given. However, one embodiment of the present invention is not limited thereto as long as contamination of the transistor can be prevented. The barrier layer 6207 is formed so as to have a light-transmitting property with respect to at least visible light; for example, the barrier layer 6207 is formed using a light-transmitting material or a film to be thin enough to have a light-transmitting property. Note that a second adhesive layer (not illustrated) may be formed using an adhesive which is different from the adhesive 6203 for separation, and the metal plate 6206 may be bonded.

Then, the first adhesive layer 6111 is formed on the surface of the metal plate 6206, and the transfer substrate 6110 is attached to the first adhesive layer 6111 (FIG. 16D2), and the temporary supporting substrate 6202 is separated from the layer to be separated 6116 (FIG. 16E2), whereby an element substrate which is lightweight and has high resistance to shock can be formed similarly. Note that a backlight is turned on, so that the transfer substrate 6110 is irradiated with light from the direction shown by arrows in the drawing.

The element substrate formed in this manner, which is lightweight and has high resistance to shock, and a counter substrate are provided with a liquid crystal layer interposed therebetween and are fixed to each other using a sealant, whereby a liquid crystal display device which is lightweight and has high resistance to shock can be formed. As the counter substrate, a substrate which has high toughness and a light-transmitting property with respect to visible light (a substrate similar to a plastic substrate which can be used for the transfer substrate 6110) can be used. The substrate may be provided with a polarization plate, a black matrix, and an alignment film, if necessary. As a method for forming a liquid crystal layer, a dispenser method, an injection method, or the like can be employed.

In the liquid crystal display device which is lightweight and has high resistance to shock, which is formed as described above, a minute element such as a transistor can be formed over a glass substrate which has relatively good stability of the dimension or the like, and a conventional manufacturing method can be employed. Therefore, a minute element can be formed with high accuracy. Accordingly, the liquid crystal display device which can provide a high quality image with high definition and is lightweight while having resistance to shock can be provided.

Further, the liquid crystal display device which is formed as described above can also have flexibility.

<Various Kinds of Electronic Devices Including Liquid Crystal Display Device>

Examples of electronic devices each including the liquid crystal display device disclosed in this specification will be described below with reference to FIGS. 18A to 18F.

Figure 18A:
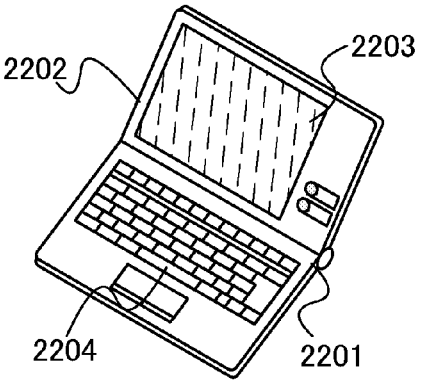
FIGS. 18A to 18F each illustrate an example of an electronic device.

FIG. 18A illustrates a laptop personal computer, which includes a main body 2201, a housing 2202, a display portion 2203, a keyboard 2204, and the like.

Figure 18B:
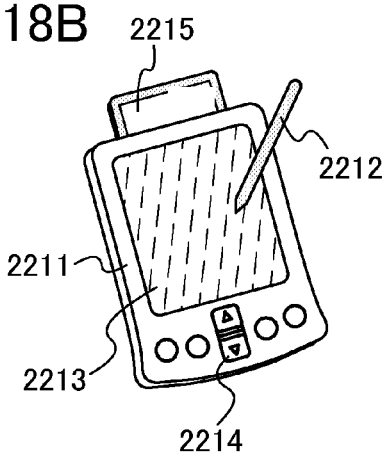

FIG. 18B illustrates a portable information terminal (PDA), which includes a main body 2211 provided with a display portion 2213, an external interface 2215, operation buttons 2214, and the like. Further, a stylus 2212 for operation is included as an accessory.

Figure 18C:
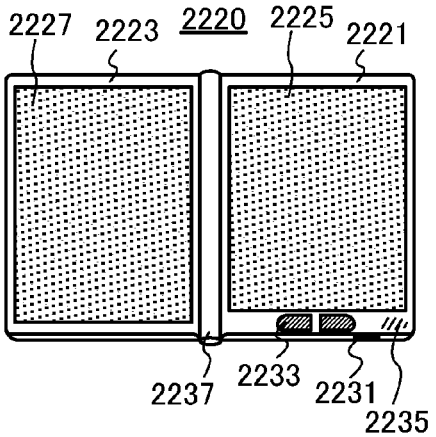

FIG. 18C illustrates an e-book reader 2220. The e-book reader 2220 includes two housings 2221 and 2223. The housings 2221 and 2223 are combined with each other with a hinge 2237 so that the e-book reader 2220 can be opened and closed with the hinge 2237 used as an axis. With such a structure, the e-book reader 2220 can be used like a paper book.

A display portion 2225 is incorporated in the housing 2221, and a display portion 2227 is incorporated in the housing 2223. The display portions 2225 and 2227 may display one image or different images. In the case where the display portions 2225 and 2227 display different images, for example, a display portion on the right side (the display portion 2225 in FIG. 18C) can display text and a display portion on the left side (the display portion 2227 in FIG. 18C) can display images.

Further, in FIG. 18C, the housing 2221 includes an operation portion and the like. For example, the housing 2221 includes a power button 2231, operation keys 2233, a speaker 2235, and the like. With the operation keys 2233, pages can be turned. Note that a keyboard, a pointing device, or the like may be provided on the same surface as the display portion of the housing. Further, an external connection terminal (e.g., an earphone terminal, a USB terminal, or a terminal which can be connected to an AC adapter or a variety of cables such as USB cables), a recording medium insertion portion, or the like may be provided on a back surface or a side surface of the housing. Furthermore, the e-book reader 2220 may function as an electronic dictionary.

The e-book reader 2220 may transmit and receive data wirelessly. Through wireless communication, desired book data or the like can be purchased and downloaded from an electronic book server.

Figure 18D:
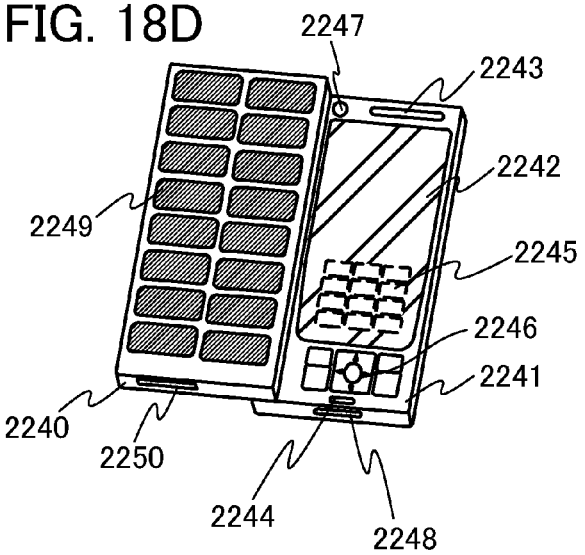

FIG. 18D illustrates a cellular phone. The cellular phone includes two housings 2240 and 2241. The housing 2241 includes a display panel 2242, a speaker 2243, a microphone 2244, a pointing device 2246, a camera lens 2247, an external connection terminal 2248, and the like. The housing 2240 includes a solar cell 2249 for storing electricity in the cellular phone, an external memory slot 2250, and the like. Further, an antenna is incorporated in the housing 2241.

The display panel 2242 has a touch panel function. A plurality of operation keys 2245 which are displayed as images are indicated by dashed lines in FIG. 18D. Note that the cellular phone includes a boosting circuit for raising voltage output from the solar cell 2249 to voltage needed for each circuit. Further, the cellular phone can include a contactless IC chip, a small recording device, or the like in addition to the above-described structure.

The display direction of the display panel 2242 is changed as appropriate in accordance with applications. Further, the camera lens 2247 is provided on the same surface as the display panel 2242; thus, the cellular phone can be used as a video phone. The speaker 2243 and the microphone 2244 can be used for videophone calls, recording, and playing sound, and the like as well as voice calls. Furthermore, the housings 2240 and 2241 which are developed as illustrated in FIG. 18D can overlap with each other by sliding; thus, the size of the cellular phone can be decreased, which makes the cellular phone suitable for being carried.

The external connection terminal 2248 can be connected to an AC adapter or a variety of cables such as USB cables, so that electricity can be stored and data communication can be performed. In addition, a larger amount of data can be saved and moved by insertion of a recording medium in the external memory slot 2250. Further, in addition to the above functions, the cellular phone may have an infrared communication function, a television reception function, or the like.

Figure 18E:
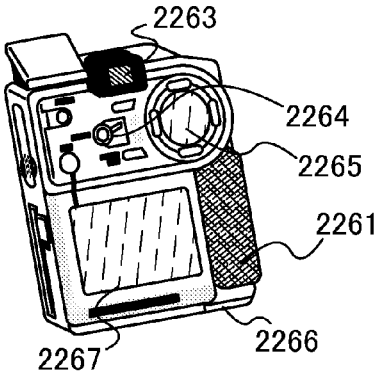

FIG. 18E illustrates a digital camera. The digital camera includes a main body 2261, a display portion A 2267, an eyepiece portion 2263, an operation switch 2264, a display portion B 2265, a battery 2266, and the like.

Figure 18F:
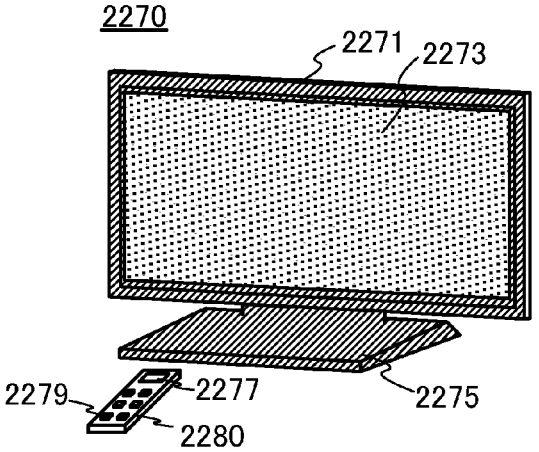

FIG. 18F illustrates a television set. A television set 2270 includes a display portion 2273 incorporated in a housing 2271. The display portion 2273 can display images. Note that here, the housing 2271 is supported by a stand 2275.

The television set 2270 can be operated by an operation switch of the housing 2271 or a remote control 2280. Channels and volume can be controlled with operation keys 2279 of the remote control 2280, so that an image displayed on the display portion 2273 can be controlled. Further, the remote control 2280 may have a display portion 2277 for displaying data output from the remote control 2280.

Note that the television set 2270 preferably includes a receiver, a modem, and the like. A general television broadcast can be received with the receiver. Further, when the television set is connected to a communication network with or without wires via the modem, one-way (from a transmitter to a receiver) or two-way (between a transmitter and a receiver or between receivers) data communication can be performed.

This application is based on Japanese Patent Application serial no. 2010-167161 filed with Japan Patent Office on Jul. 26, 2010, the entire contents of which are hereby incorporated by reference.

What is claimed is:

1. A liquid crystal display device comprising:

a pixel portion including a plurality of pixels arranged in m rows and n columns;

a driver circuit configured to input a first image signal for controlling transmission of light of one of a first color and a third color to n pixels arranged in a first row to n pixels arranged in an A-th row (A is a natural number less than or equal to m/2), and a second image signal for controlling transmission of light of one of a second color and a fourth color to n pixels arranged in a (A+1)-th row to n pixels arranged in a 2A-th row;

a backlight provided behind the pixel portion, the backlight comprising a plurality of backlight units arranged in a matrix, wherein each of the backlight units comprises a plurality of light sources emitting lights, and the light sources emit light of respective colors; and a backlight control circuit configured to irradiate the n pixels arranged in the first row to n pixels arranged in a B-th row (B is a natural number less than or equal to A/2) with the light of the one of the first color and the third color, and irradiate the n pixels arranged in the (A+1)-th row to n pixels arranged in a (A+B)-th row with the light of the one of the second color and the fourth color among the plurality of backlight units in a period that the driver circuit inputs the first image signal to n pixels arranged in a (B+1)-th row to the n pixels arranged in the A-th row, and the second image signal to n pixels arranged in a (A+B+1)-th row to the n pixels arranged in the 2A-th row, and configured to irradiate the n pixels arranged in the (B+1)-th row to the n pixels arranged in the A-th row with the light of the one of the first color and the third color, and irradiate the n pixels arranged in the (A+B+1)-th row to the n pixels arranged in the 2A-th row with the light of the one of the second color and the fourth color among the plurality of backlight units after the period, wherein, to display a first image, each of the light of the first color and the second color is formed by turning on any one of the light sources, wherein, to display a second image after displaying the first image, each of the light of the third color and the fourth color is formed by turning on at least two of the light sources, wherein the driver circuit is configured to input the first image signal and the second image signal, concurrently, and wherein a part of an irradiating period of the n pixels arranged in the first row to the n pixels arranged in the B-th row with the light of the one of the first color and the third color and the n pixels arranged in the (A+1)-th row to the n pixels arranged in the (A+B)-th row with the light of the one of the second color and the fourth color and a part of an irradiating period of the n pixels arranged in the (B+1)-th row to the n pixels arranged in the A-th row with the light of the one of the first color and the third color and the n pixels arranged in the (A+B+1)-th row to the n pixels arranged in the 2A-th row with the light of the one of the second color and the fourth color overlap with each other.

2. The liquid crystal display device according to claim 1, wherein each of the backlight units comprises a light source that emits red light, a light source that emits green light, and a light source that emits blue light.

3. The liquid crystal display device according to claim 1, wherein each of the backlight units comprises at least three light sources.

4. The liquid crystal display device according to claim 1, wherein the backlight control circuit is configured to irradiate the pixel portion with the first color, the third color, and a fifth color sequentially so that the first image is formed, and irradiate the pixel portion with the second color, the fourth color, and a sixth color sequentially so that the second image is formed following the first image.

5. The liquid crystal display device according to claim 4, wherein the first color, the third color, the fifth color, the second color, the fourth color, and the sixth color are red, blue, green, cyan, magenta, and yellow, respectively.

6. A driving method of a liquid crystal display device that performs a field sequential method in a pixel portion including a plurality of pixels arranged in m rows and n columns (m and n are each a natural number greater than or equal to 4), wherein the liquid crystal display device comprises a plurality of light sources emitting lights, comprising the steps of:

in a first period in which a first image signal for controlling transmission of light of a first color is input to n pixels arranged in a first row to n pixels arranged in an A-th row (A is a natural number less than or equal to m/2) and a second image signal for controlling transmission of light of a second color is sequentially input to n pixels arranged in a (A+1)-th row to n pixels arranged in a 2A-th row, supplying the light of the first color to the n pixels arranged in the first row to n pixels arranged in a B-th row (B is a natural number less than or equal to A/2), and the light of the second color to the n pixels arranged in the (A+1)-th row to n pixels arranged in a (A+B)-th row to form a first image in the pixel portion in a period of inputting the first image signal to n pixels arranged in a (B+1)-th row to the n pixels arranged in the A-th row, and the second image signal to n pixels arranged in a (A+B+1)-th row to the n pixels arranged in the 2A-th row, and supplying the light of the first color to the n pixels arranged in the (B+1)-th row to the n pixels arranged in the A-th row, and the light of the second color to the n pixels arranged in the (A+B+1)-th row to the n pixels arranged in the 2A-th row to form the first image in the pixel portion after the period; and in a second period in which a third image signal for controlling transmission of light of a third color is input to the n pixels arranged in the first row to the n pixels arranged in the A-th row and a fourth image signal for controlling transmission of light of a fourth color is input to the n pixels arranged in the (A+1)-th row to the n pixels arranged in the 2A-th row after the first period, supplying the light of the third color to the n pixels arranged in the first row to the n pixels arranged in the B-th row, and the light of the fourth color to the n pixels arranged in the (A+1)-th row to the n pixels arranged in the (A+B)-th row to form a second image in the pixel portion in a period of inputting the third image signal to the n pixels arranged in a (B+1)-th row to the n pixels arranged in the A-th row, and the fourth image signal to the n pixels arranged in a (A+B+1)-th row to the n pixels arranged in the 2A-th row, and supplying the light of the third color to the n pixels arranged in the (B+1)-th row to the n pixels arranged in the A-th row, and the light of the fourth color to the n pixels arranged in the (A+B+1)-th row to the n pixels arranged in the 2A-th row to form the second image in the pixel portion after the period, wherein a part of a period of the supplying the light of the first color to the n pixels arranged in the first row to the n pixels arranged in the B-th row and the supplying the light of the second color to the n pixels arranged in the (A+1)-th row to the n pixels arranged in the (A+B)-th row and a part of a period of the supplying the light of the first color to the n pixels arranged in the (B+1)-th row to the n pixels arranged in the A-th row and the supplying the light of the second color to the n pixels arranged in the (A+B+1)-th row to the n pixels arranged in the 2A-th row overlap with each other, wherein a part of a period of the supplying the light of the third color to the n pixels arranged in the first row to the n pixels arranged in the B-th row and the supplying the light of the fourth color to the n pixels arranged in the (A+1)-th row to the n pixels arranged in the (A+B)-th row and a part of a period of the supplying the light of the third color to the n pixels arranged in the (B+1)-th row to the n pixels arranged in the A-th row and the supplying the light of the fourth color to the n pixels arranged in the (A+B+1)-th row to the n pixels arranged in the 2A-th row overlap with each other, wherein the light sources emit light of respective colors, wherein each of the light of the first color and the light of the second color is formed by turning on any one of the light sources, wherein each of the light of the third color and the light of the fourth color is formed by turning on at least two of the light sources, wherein the light of the first color is different from the light of the second color, and the light of the third color is different from the light of the fourth color, wherein the first image signal and the second image signal are input concurrently, and wherein the third image signal and the fourth image signal are input concurrently.

7. The driving method of a liquid crystal display device, according to claim 6, wherein the light of the first color is any one of red light, green light, and blue light, wherein the light of the second color is any one of red light, green light, and blue light, wherein the light of the third color is light formed by color mixture of any two of red light, green light, and blue light, and wherein the light of the fourth color is light formed by color mixture of any two of red light, green light, and blue light.

* * * * *